US007979003B2

(12) United States Patent
Aoshima et al.

(10) Patent No.: US 7,979,003 B2
(45) Date of Patent: Jul. 12, 2011

(54) IMAGE FORMING APPARATUS AND IMAGE FORMING METHOD

(75) Inventors: Taku Aoshima, Ebina (JP); Yutaka Kanai, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 415 days.

(21) Appl. No.: 12/176,686

(22) Filed: Jul. 21, 2008

(65) Prior Publication Data

US 2009/0087219 A1 Apr. 2, 2009

(30) Foreign Application Priority Data

Sep. 28, 2007 (JP) ..... 2007-256385

(51) Int. Cl.

| | |
|---|---|
| ***G03G 15/00*** | (2006.01) |
| ***G03G 15/02*** | (2006.01) |
| ***G03G 21/00*** | (2006.01) |
| ***G03G 21/18*** | (2006.01) |

(52) U.S. Cl. ..... 399/128; 399/50; 399/51; 399/89; 399/115

(58) Field of Classification Search ..... 399/50, 399/51, 89, 128, 129, 115
See application file for complete search history.

(56) References Cited

U.S. PATENT DOCUMENTS

| | | | | |
|---|---|---|---|---|
| 3,992,204 | A * | 11/1976 | Taylor | 430/46.1 |
| 4,110,026 | A * | 8/1978 | Farley et al. | 399/128 |
| 4,119,373 | A * | 10/1978 | Frishman et al. | 399/128 |
| 4,529,292 | A * | 7/1985 | Ohseto | 399/128 |
| 4,619,518 | A * | 10/1986 | Kameyama et al. | 399/231 |
| 4,645,330 | A * | 2/1987 | Kohyama et al. | 399/128 |
| 4,669,855 | A * | 6/1987 | Iwahashi | 399/128 |
| 5,740,493 | A * | 4/1998 | Otaki et al. | 399/71 |
| 6,998,209 | B2 * | 2/2006 | Ikuno et al. | 430/57.3 |
| 7,715,744 | B2 * | 5/2010 | Miyazawa et al. | 399/55 |
| 7,826,758 | B2 * | 11/2010 | Miyazawa et al. | 399/55 |
| 2008/0260400 | A1 * | 10/2008 | Miyazawa et al. | 399/53 |

FOREIGN PATENT DOCUMENTS

| | | |
|---|---|---|
| JP | 57-176087 | 10/1982 |
| JP | 60-156068 | 8/1985 |
| JP | 61-038969 | 2/1986 |
| JP | 01-191883 | 8/1989 |
| JP | 01-274185 | 11/1989 |
| JP | 01-298387 | 12/1989 |
| JP | 5-088593 | 4/1993 |
| JP | 06-214497 | 8/1994 |
| JP | 07-181766 | 7/1995 |
| JP | 2000-200015 | 7/2000 |
| JP | 2000-338829 | 12/2000 |

* cited by examiner

*Primary Examiner* — David M Gray
*Assistant Examiner* — Francis Gray
(74) *Attorney, Agent, or Firm* — Morgan, Lewis & Bockius LLP

(57) ABSTRACT

The image forming apparatus including: a photoconductor provided with a charge generation layer and an overcoat layer; a first charging unit charging the photoconductor when an image is formed; an exposure unit irradiating the photoconductor with light having a wavelength to which a relative sensitivity of the charge generation layer is larger than a relative sensitivity of the overcoat layer; a development unit developing an electrostatic latent image formed on the photoconductor by the first charging unit and the exposure unit with toner; a transfer unit transferring an image developed on the photoconductor to a medium; a light irradiation unit irradiating the photoconductor with light having a wavelength to which the relative sensitivity of the overcoat layer is larger than the relative sensitivity of the charge generation layer; and an erasing unit erasing a charge from the photoconductor irradiated with light by the light irradiation unit.

21 Claims, 12 Drawing Sheets

FIG.10

| SAMPLE NAME | LIGHT IRRADIATION BY LIGHT SOURCE FOR LIGHT-INDUCED FATIGUE | SURFACE POTENTIAL OF PHOTOCONDUCTOR DRUM AT REVERSE CHARGE BIAS | TIME FOR REVERSE CHARGE BIAS | DEVELOPMENT BIAS | UNEVENNESS OF IMAGE |
|---|---|---|---|---|---|
| S1 | YES | + 860 V | 3 MIN. | + 1000 V | B |
| S2 | YES | + 860 V | 5 MIN. | + 1000 V | A |
| S3 | YES | + 1360 V | 3 MIN. | +1500 V | A |
| S4 | NO | 0 V | 0 MIN. | 0 V | D |
| S5 | YES | 0 V | 0 MIN. | 0 V | D |
| S6 | NO | + 860 V | 5 MIN. | + 1000 V | C |

A : UNEVENNESS OF IMAGE IS NOT RECOGNIZED
B : UNEVENNESS OF IMAGE IS HARDLY RECOGNIZED
C : UNEVENNESS OF IMAGE IS SLIGHTLY RECOGNIZED
D : UNEVENNESS OF IMAGE IS CLEARLY RECOGNIZED

FIG.12

| SAMPLE NAME | LIGHT IRRADIATION BY LIGHT SOURCE FOR LIGHT-INDUCED FATIGUE | HEATING TEMPERATURE | HEATING TIME | UNEVENNESS OF IMAGE |
|---|---|---|---|---|
| S11 | YES | 40 ℃ | 1 MIN. | B |
| S12 | YES | | 3 MIN. | A |
| S13 | YES | | 5 MIN. | A |
| S14 | YES | | 10 MIN. | A |
| S15 | YES | 50 ℃ | 1 MIN. | A |
| S16 | YES | | 3 MIN. | A |
| S17 | YES | | 5 MIN. | A |
| S18 | YES | | 10 MIN. | A |
| S19 | YES | 60 ℃ | 1 MIN. | A |

A : UNEVENNESS OF IMAGE IS NOT RECOGNIZED
B : UNEVENNESS OF IMAGE IS HARDLY RECOGNIZED
C : UNEVENNESS OF IMAGE IS SLIGHTLY RECOGNIZED
D : UNEVENNESS OF IMAGE IS CLEARLY RECOGNIZED

IMAGE FORMING APPARATUS AND IMAGE FORMING METHOD

CROSS REFERENCE TO RELATED APPLICATIONS

This application is based on and claims priority under 35 USC §119 from Japanese Patent Application No. 2007-256385 filed Sep. 28, 2007.

BACKGROUND

1. Technical Field

The present invention relates to an image forming apparatus that is provided with a photoconductor, and an image forming method.

2. Related Art

In an imaging forming apparatus such as an electrophotographic copier and the like, for example, a toner image is obtained by charging a photoconductor drum, exposing selectively the photoconductor drum after the charging to form an electrostatic latent image and then developing the electrostatic latent image with toner charged to a predetermined polarity. Here, the photoconductor drum is provided with an electroconductive substrate made of, for example, a metal, and a photoconductor provided on a surface of the substrate. The photoconductor includes a monolayer photoconductor containing both a charge generation material and a charge transport material, and a multilayer photoconductor obtained by laminating a charge generation layer containing a charge generation material and a charge transport layer containing a charge transport material.

Typically, on a photoconductor, light-induced fatigue (light-induced fatigue refers to a state where a part of a photoconductor is exposed to light and the electric property thereof is temporarily changed compared with that of other parts) occurs after the photoconductor is exposed to light, and the exposure history remains in an image. In particular, when only a part of the photoconductor is exposed to light, there occurs a difference in image density between a portion exposed to light and a portion not exposed to light. Such a history is caused because an electric charge generated in the photoconductor by exposure to light is captured by a trap in the photoconductor.

SUMMARY

According to an aspect of the invention, there is provided an image forming apparatus including: a photoconductor that is provided with a charge generation layer and an overcoat layer; a first charging unit that charges the photoconductor when an image is formed; an exposure unit that irradiates the photoconductor with light having a wavelength to which a relative sensitivity of the charge generation layer is larger than a relative sensitivity of the overcoat layer, the relative sensitivity of the charge generation layer being a sensitivity to light having a wavelength range normalized by a maximum sensitivity of the charge generation layer in the wavelength range and the relative sensitivity of the overcoat layer being a sensitivity to light having a wavelength range normalized by a maximum sensitivity of the overcoat layer in the wavelength range; a development unit that develops an electrostatic latent image formed on the photoconductor by the first charging unit and the exposure unit with toner; a transfer unit that transfers an image developed on the photoconductor to a medium; a light irradiation unit that irradiates the photoconductor with light having a wavelength to which the relative sensitivity of the overcoat layer is larger than the relative sensitivity of the charge generation layer; and an erasing unit that erases a charge from the photoconductor irradiated with light by the light irradiation unit.

BRIEF DESCRIPTION OF THE DRAWINGS

Exemplary embodiment(s) of the present invention will be described in detail based on the following figures, wherein:

FIG. 10 is a table showing the list of the conditions and results in the evaluation tests;

FIG. 12 is a table showing the list of the conditions and results in the evaluation tests.

DETAILED DESCRIPTION

Hereinafter, a detailed description will be given for exemplary embodiments of the present invent Ion with reference to attached drawings.

First Exemplary Embodiment

Figure 1:
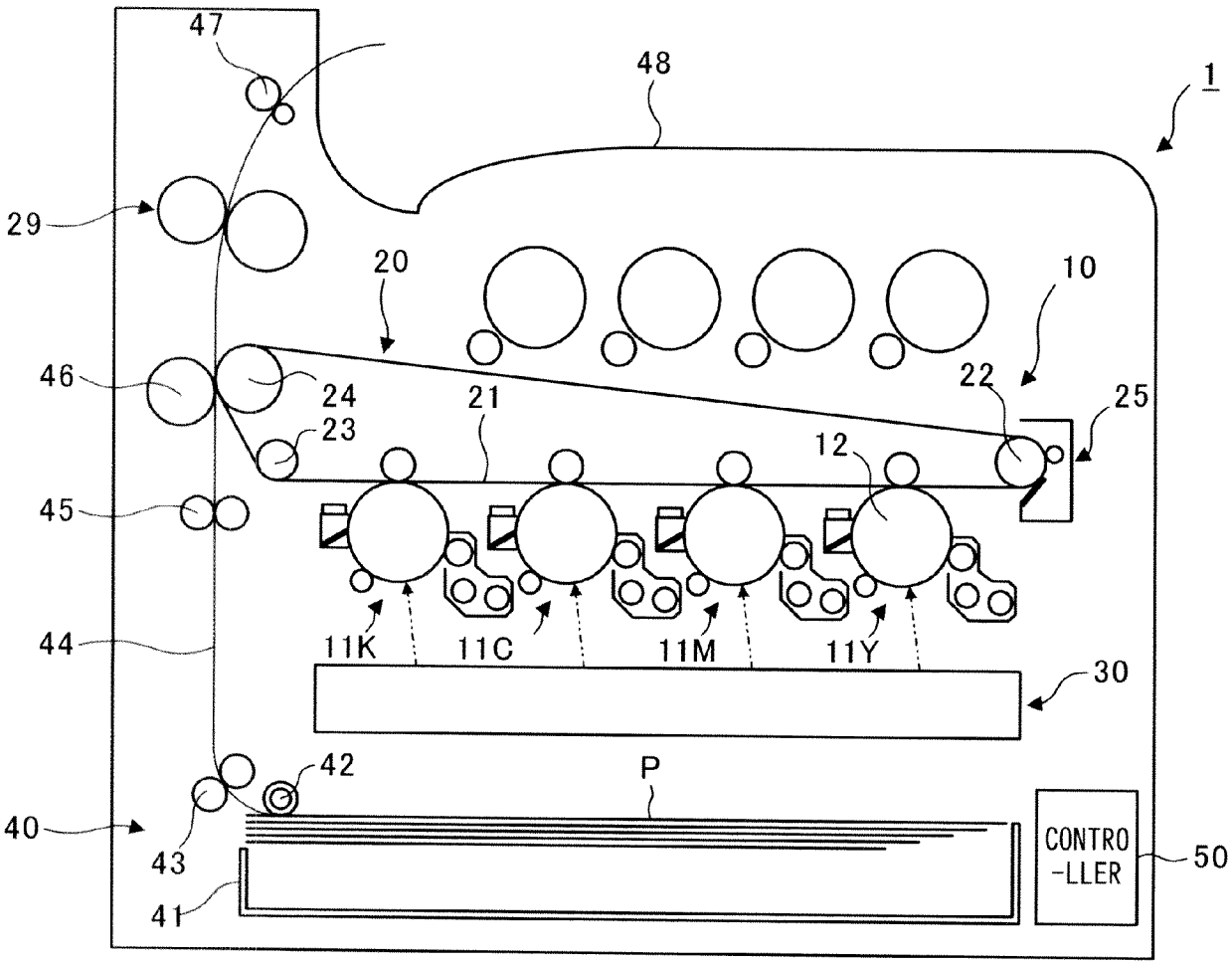
FIG. 1 is a view showing an entire configuration of a printer as an image forming apparatus to which the first exemplary embodiment is applied.

FIG. 1 is a view showing an entire configuration of a printer 1 as an image forming apparatus to which the first exemplary embodiment is applied. The printer 1 is provided with an image forming unit 10 that forms images in accordance with respective color tone data, a paper sheet transportation unit 40 that transports a paper sheet P, and a controller 50 as an example of a controller that controls operation of the printer 1 including the image forming unit 10 and the paper sheet transportation unit 40.

The image forming unit 10 is provided with four image forming parts 11Y for yellow (Y), 11M for magenta (M), 11C for cyan (C) and 11K for black (K) that are arranged in parallel at certain intervals in a horizontal direction, a transfer unit 20 that superimposingly transfers respective color toner images formed on photoconductor drums 12 of the image forming parts 11Y, 11M, 11C and 11K onto an intermediate transfer belt 21, and an exposure unit 30 that irradiates the image forming parts 11Y, 11M, 11C and 11K with a laser. Further, the printer 1 is provided with a fixing unit 29 that fixes, with heat and pressure, the toner images that have been secondarily transferred onto the paper sheet P by the transfer unit 20.

The transfer unit 20 as an example of a transfer unit is provided with a driving roll 22 that drives the intermediate transfer belt 21, a tension roll 23 that applies certain tension to the intermediate transfer belt 21, a back-up roll 24 for secondarily transferring the superimposed color toner images onto the paper sheet P, and a belt cleaner 25 that removes remaining toner and the like on the intermediate transfer belt 21. The intermediate transfer belt 21 as an example of a medium is stretched between the driving roll 22, the tension roll 23 and the back-up roll 24, and is circularly moved at a predetermined speed by the driving roll 22 that is rotationally driven by a belt driving motor (not shown in the figure). For example, as the intermediate transfer belt 21, a resister-controlled one made of a belt material (rubber or resin) in which charge-up (rapid charge rising) hardly occurs is used. The belt cleaner 25 is configured so as to remove the remaining toner and the like from the surface of the intermediate transfer belt 21 after completion of the secondary transfer of the toner image.

The exposure unit 30 as an example of an exposure unit is provided with a laser diode, a modulator, a polygon mirror, various kinds of lenses, mirrors and the like (that are not shown in the figure), and is configured so as to scan and expose the photoconductor drums 12 of the image forming parts 11Y, 11M, 11C and 11K with a laser. It should be noted that, in the first exemplary embodiment, a laser diode with an oscillation wavelength of 780 nm is used.

The paper sheet transportation unit 40 Is provided with a paper sheet stacking part 41 that stacks paper sheets P, a pick-up roll 42 that takes out a paper sheet P from the paper sheet stacking part 41 and supplies the paper sheets P, a separation rolls 43 that separate the paper sheets P supplied by the pick-up roll 42 one by one, and transport the paper sheet P, and a transporting path 44 for transporting the paper sheet P that has been separated one by one by the separation rolls 43, toward the secondary transfer position. Further, the paper sheet transportation unit 40 is provided with registration rolls 45 that transport the paper sheet P which is to be transported in the transporting path 44 toward the secondary transfer position at a right timing, and a secondary transfer roll 46 that is provided at the secondary transfer position and is in contact with the back-up roll 24 with pressure through the paper sheet P to secondarily transfer an image onto the paper sheet P. Furthermore, the paper sheet transportation unit 40 is provided with an exit roll 47 that outputs, outside the printer 1, the paper sheet P on which the images has been fixed by the fixing unit 29, and an outputted paper sheet stacking part 48 that stacks the paper sheet P outputted by the exit roll 47.

Figure 2:
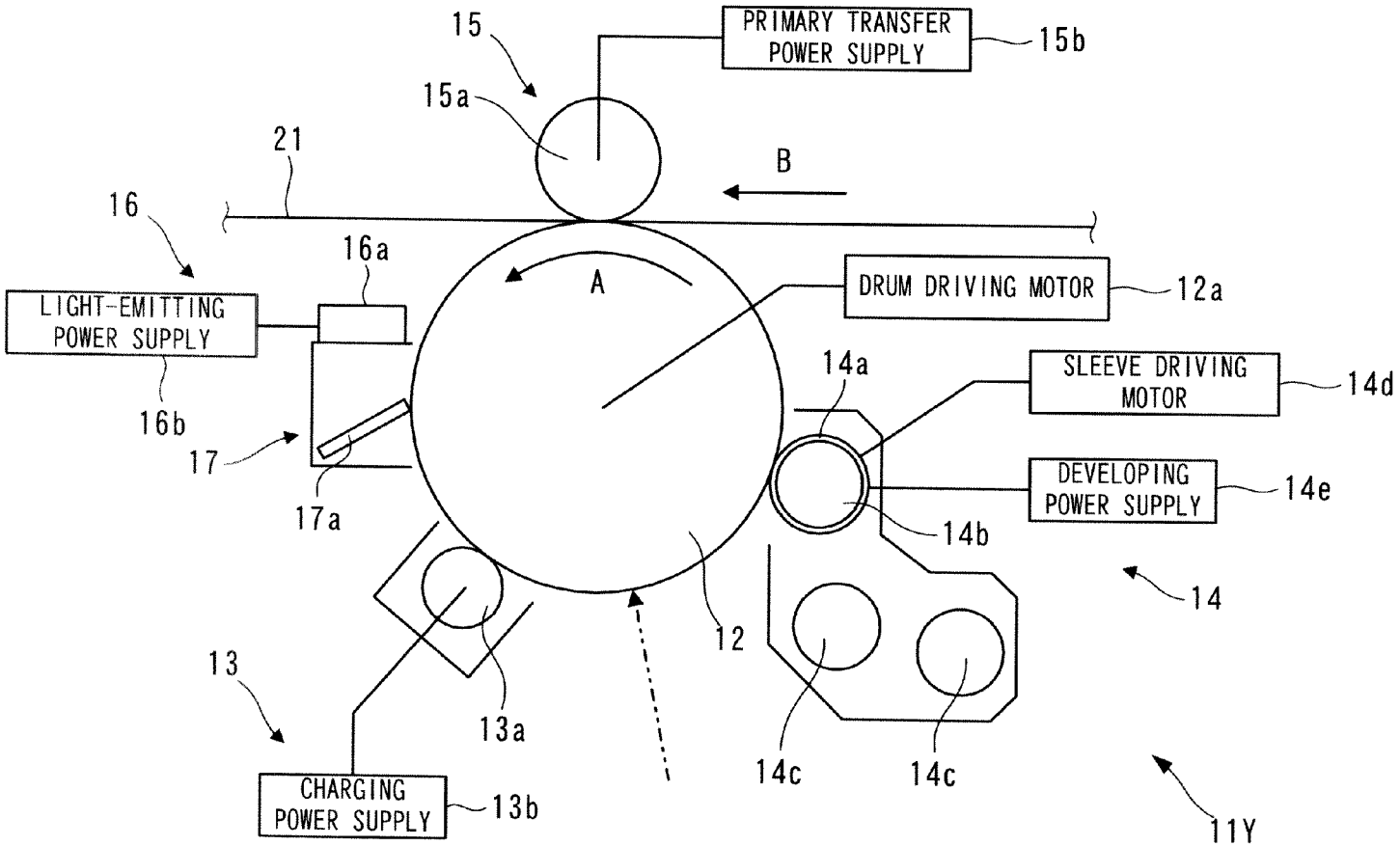
FIG. 2 is a diagram for explaining a configuration of the image forming part for yellow.

FIG. 2 is a diagram for explaining a configuration of the image forming part 11Y for yellow. Although, the image forming part 11Y for yellow is described as an example, each of the image forming parts 11M, 11C and 11K for the other colors has the same configuration except used toner colors.

The image forming part 11Y for yellow is provided with the photoconductor drum 12 that rotates in an arrow A direction. To the photoconductor drum 12, a drum driving motor 12*a* that rotationally drives the photoconductor drum 12 is connected. Around the photoconductor drum 12, a charging device 13, a development device 14, a primary transfer device 15, a light irradiation device 16 and a photoconductor cleaner 17 are sequentially arranged along the arrow A direction.

Among them, the charging device 13 as an example of a first charging unit, an erasing unit and a second charging unit is provided with a charging roll 13*a* that is arranged so as to be in contact with the photoconductor drum 12, and a charging power supply 13*b* that supplies a charge bias to the charging roll 13*a*. Here, the charging roll 13*a* is rotated by driving of the photoconductor drum 12. The charging power supply 13*b* selectively supplies a direct-current charge bias having a positive polarity or a negative polarity to the charging roll 13*a*. Alternatively, the charging power supply 13*b* may apply an alternate-current charge bias superimposed on the direct-current charging bias having the positive or negative polarity to the charging roll 13*a*.

The development device 14 as an example of a development unit is provided with a developing sleeve 14*a* that is arranged so as to be opposed to the photoconductor drum 12, a magnet roll 14*b* surrounded by the developing sleeve 14*a*, and supply members 14*c* that supply a two-component developer including toner and magnetic carriers to a developing roll formed by the developing sleeve 14*a* and the magnet roll 14*b*. In the first exemplary embodiment, while the magnet roll 14*b* is fixed, the developing sleeve 14*a* is rotated. In the two-component developer, the toner has a negative-charge. The development device 14 is further provided with a sleeve driving motor 14*d* that rotationally drives the developing sleeve 14*a*, and a developing power supply 14*e* that supplies a developing bias to the developing sleeve 14*a*. In the first exemplary embodiment, the developing power supply 14*e* selectively supplies a direct-current developing bias having a positive polarity or a negative polarity to the developing sleeve 14*a*. Alternatively, the developing power supply 14*e* may apply an alternate-current developing bias superimposed on the direct-current developing bias having the positive or negative polarity to the developing sleeve 14*a*.

The primary transfer device 15 is provided with a primary transfer roll 15*a* that is arranged so as to be opposed to the photoconductor drum 12 through the intermediate transfer belt 21, and a primary transfer power supply 15*b* that supplies a primary transfer bias to the primary transfer roll 15*a*. The primary transfer roll 15*a* is rotated by receiving driving force of the intermediate transfer belt 21 that rotates in an arrow B direction same as the arrow A direction which is the rotating direction of the photoconductor drum 12, at a position where the primary transfer roll 15*a* is opposed to the photoconductor drum 12. The primary transfer power supply 15*b* supplies a primary transfer bias having a positive polarity to the primary transfer roll 15*a*.

The light irradiation device 16 is provided with a light emitting part 16*a* that is arranged so as to be opposed to the photoconductor drum 12, and a light-emitting power supply 16*b* that supplies electric power for light emission to the light emitting part 16*a*. The detail configuration of the light irradiation device 16 will be described later.

The photoconductor cleaner 17 is provided with a blade member 17*a* that is arranged so as to be in contact with the photoconductor drum 12.

The controller 50 shown in FIG. 1 controls operation of the above-described drum driving motor 12*a*, charging power supply 13*b*, sleeve driving motor 14*d*, developing power supply 14*e*, primary transfer power supply 15*b* and light-emitting power supply 16*b*. In addition, the controller 50 controls operation of driving of the intermediate transfer belt 21 through the driving roll 22 shown in FIG. 1, a paper sheet transportation in the paper sheet transportation unit 40, the secondary transfer bias that is applied to the secondary transfer unit, and driving and heating in the fixing unit 29.

Figure 3:
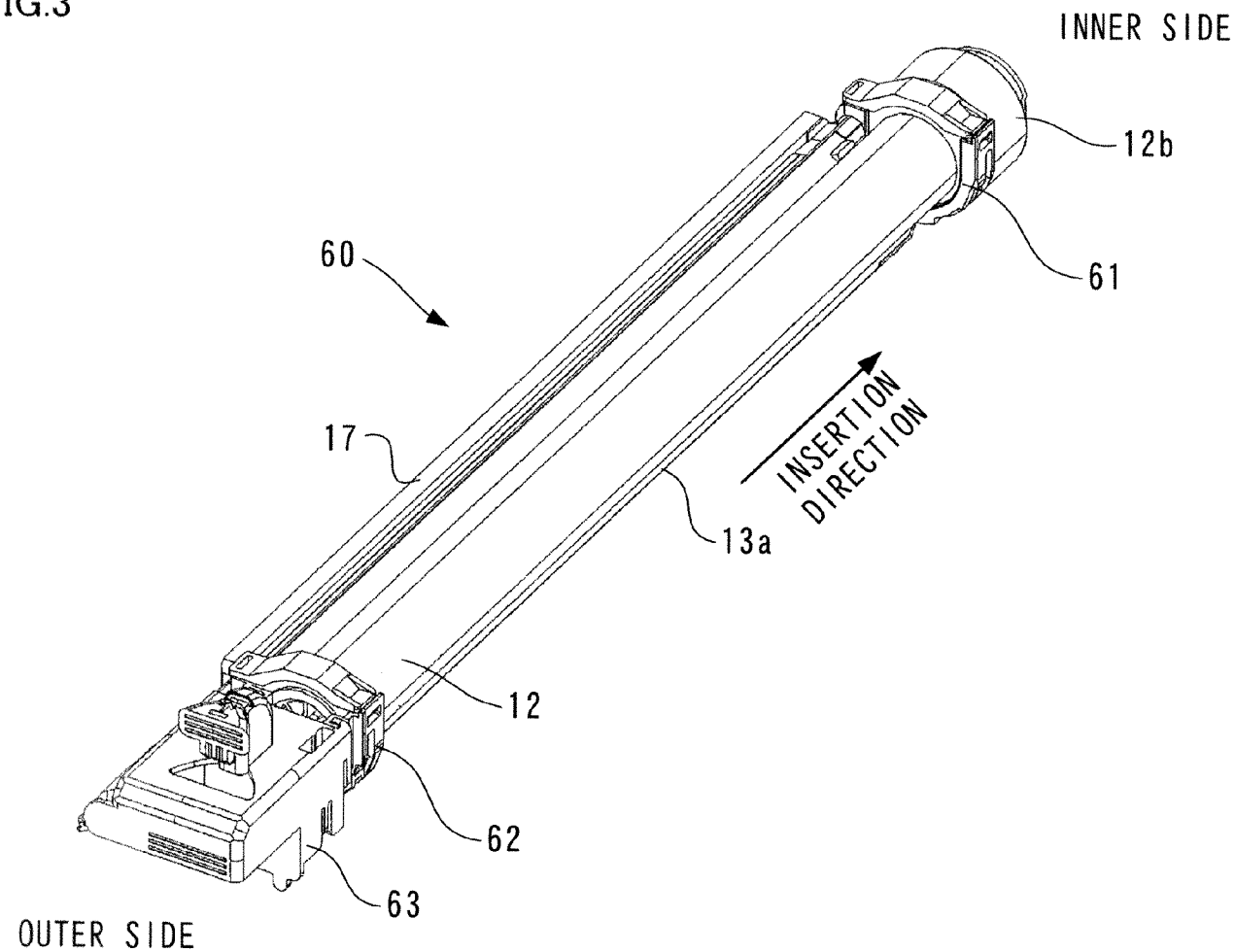
FIG. 3 is a view showing a configuration of an image forming cartridge.

In the first exemplary embodiment, the photoconductor drum 12, the charging roll 13*a* and the photoconductor cleaner 17 included in each of the image forming parts 11Y, 11M, 11C and 11K are formed to be a unit as an image forming cartridge 60 shown in FIG. 3 (a view showing a configuration of an image forming cartridge 60). In FIG. 3, "an inner side" indicates a part that is arranged on the back side of a body of the printer 1 shown in FIG. 1. In contrast, "an outer side" indicates a part that is arranged on the front side in FIG. 1. By adopting such a configuration, the image forming cartridge 60 may be attached to or detached from the body of the printer 1.

The image forming cartridge 60 contains bearings (not shown in the figure) provided at the both end portions of the photoconductor drum 12 in the axial direction, and is provided with an inner-side housing 61 and an outer-side housing 62 that support the charging device 13 and the photoconductor cleaner 17. On the inner side of the inner-side housing 61, a gear 12*b* is attached to the photoconductor drum 12. When the image forming cartridge 60 is mounted on the printer 1 shown in FIG. 1, the gear 12*b* is engaged with a driving gear (not shown in the figure) provided in the printer 1, and transmits driving force of the drum driving motor 12*a* (refer to FIG. 2) provided in the printer 1 to the photoconductor drum 12. In contrast, on the outer side of the outer-side housing 62, a handle part 63 is provided. The handle part 63 is used at the time of the operation of attaching or detaching the image forming cartridge 60 to or from the printer 1.

Figure 4:
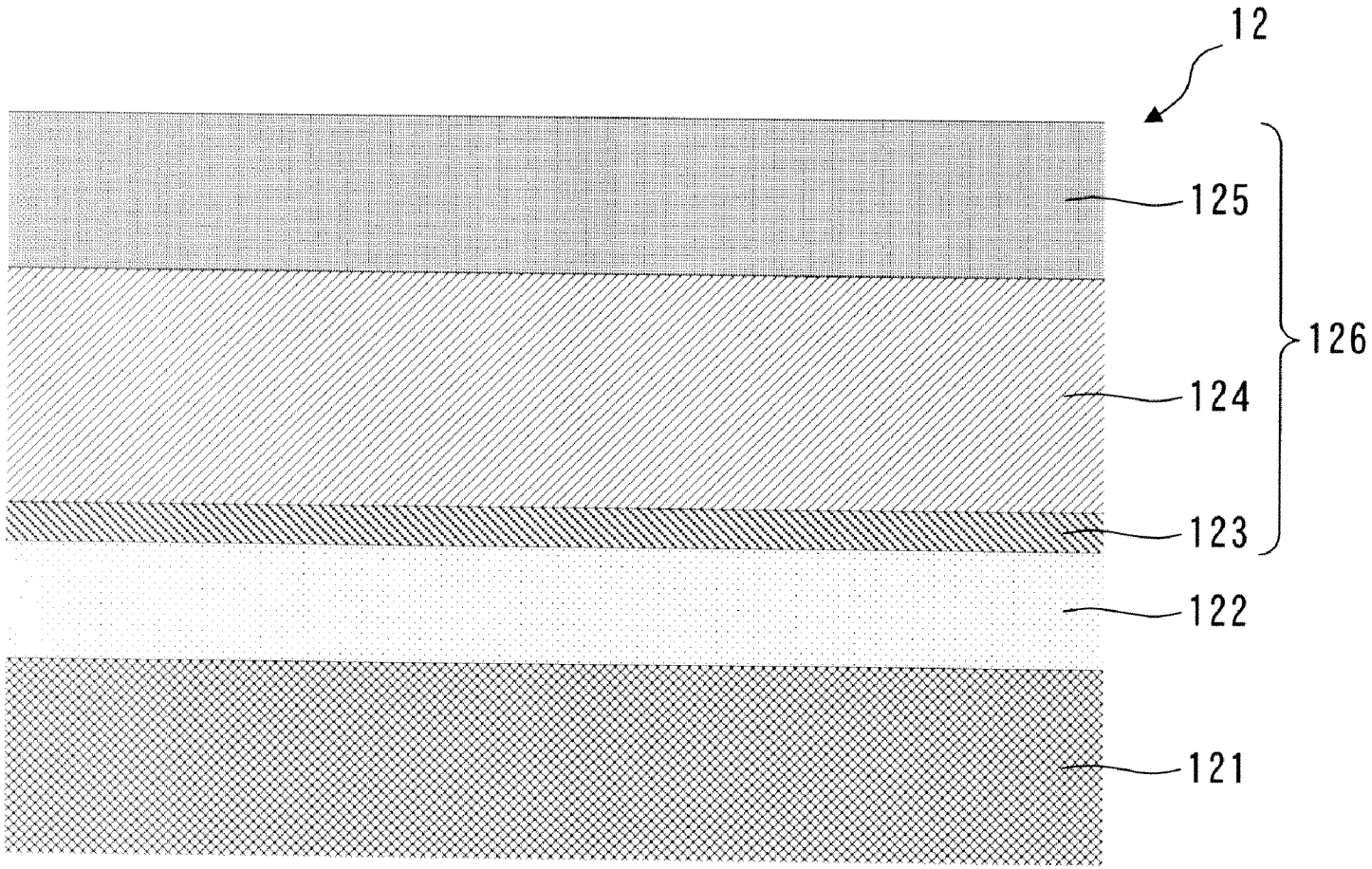
FIG. 4 is a view showing a cross-section of an outer circumferential surface in the photoconductor drum.

FIG. 4 is a view showing a cross-section of an outer circumferential surface in the photoconductor drum 12.

In the first exemplary embodiment, the photoconductor drum 12 is provided with an electroconductive substrate 121, an undercoat layer 122 formed on the electroconductive substrate 121, a charge generation layer 123 formed on the undercoat layer 122, a charge transport layer 124 formed on the charge generation layer 123 and an overcoat layer 125 formed on the charge transport layer 124. In addition, a photoconductive layer 126 is formed by the charge generation layer 123, the charge transport layer 124 and the overcoat layer 125.

Among them, the electroconductive substrate 121 is not particularly limited as long as it is a material having electric conductivity, and, for example, there is used a metal material such as an aluminum alloy and the like. It should be noted that the electroconductive substrate 121 is grounded when the image forming cartridge 60 (refer to FIG. 3) including the photoconductor drum 12 is attached to the printer 1.

The undercoat layer 122 functions as an adhesive layer which prevents the injection of a charge from the electroconductive substrate 121 to the photoconductive layer 126 and integrally holds the photoconductive layer 126 to the electroconductive substrate 121 when the photoconductive layer 126 which has a laminated structure is charged. Such an undercoat layer 122 is made of, for example, a material containing metal oxide fine particles and a binding resin.

The charge generation layer 123 generates a carrier pair which is an electron and a hole, according to light irradiation. The charge generation layer 123 is formed by containing a charge generation material and a binding resin. The charge transport layer 124 transports a carrier generated by the charge generation layer 123 according to the light irradiation. The charge transport layer 124 is formed, for example, by applying and drying a coating agent in which a charge transport material and a binding resin are dissolved and/or dispersed in a predetermined solvent. It should be noted that, in the first exemplary embodiment, the charge transport layer 124 has a function for transporting a hole as a carrier.

The overcoat layer 125 increases the abrasion resistance of the outer circumferential surface of the photoconductor drum 12 and is provided for preventing chemical changes of the charge generation layer 123 and the charge transport layer 124 when the photoconductor drum 12 is charged. In addition, the overcoat layer 125 is made of a resin containing at least one or more kinds of charge transport compounds and has a slight charge transport ability.

Here, there are illustrated constituent examples of the undercoat layer 122 and the photoconductive layer 126 (the charge generation layer 123, the charge transport layer 124 and the overcoat layer 125) as follows.

CONSTITUENT EXAMPLE 1

A solution is prepared by 20 parts by weight of acetylacetone zirconium butoxide (Orgatics ZC540, produced by Matsumoto Kosho Co., Ltd.), 2 parts by weight of γ-aminopropyltriethoxysilane (A1100, produced by Nippon Unicar Company Limited), 1.5 parts by weight of a polyvinylbutyral resin (S-LEC BM-S, produced by Sekisui Chemical Co., Ltd.) and 70 parts by weight of n-butylalcohol. The electroconductive substrate 121 formed of an aluminum pipe is dipped in the solution and coated by the solution, and then the solution is dried at 150° C. for 10 minutes to form an undercoat layer 122 having a film thickness of 0.9 μm.

A dispersion solution is prepared by dispersing 5 parts by weight of X-type non-metal phthalocyanine, 5 parts by weight of a vinyl-chloride-vinyl acetate copolymer (VMCH, produced by Union Carbide Corporation) and 200 parts by weight of n-butyl acetate for 2 hours in a sand mill using glass beads with a diameter of 1 mm. The undercoat layer 122 is dipped in the dispersion solution and is coated by the dispersion solution, and then the dispersion solution is dried at 100° C. for 10 minutes to form a charge generation layer 123 having a film thickness of 0.2 μm.

A coating agent for a charge transport layer is obtained by dissolving 45 parts by weight of N,N'-diphenyl-N,N'-bis(3-methylphenyl)-[1,1']-biphenyl-4, 4'-diamine and 55 parts by weight of a bisphenol Z polycarbonate resin (weight average molecular weight: 40,000) to 800 parts by weight of chlorbenzene. The coating agent for a charge transport layer is applied on the charge generation layer 123 and then the coating agent is dried at 130° C. for 45 minutes to form a charge transport layer 124 having a film thickness of 22 μm.

A coating agent for an overcoat layer is prepared by adding 3.5 parts by mass of a compound represented by the following structural formula (I), 3 parts by mass of RESITOP PL-4852 (produced by Gunei Chemical Industry Co., Ltd.), 0.5 parts by mass of a polyvinylphenol resin (produced by Aldrich Chemical Company Inc.), 10 parts by mass of isopropyl alcohol and 0.2 parts by mass of 3,5-di-t-butyl-4-hydroxytoluene (BHT). The coating agent for an overcoat layer is applied on the charge transport layer 124 by a dip coating method, air-dried at room temperature for 30 minutes, and then cured with heat at 150° C. for one hour to form an overcoat layer 125 having a film thickness of 4.0 μm.

structural formula (I)

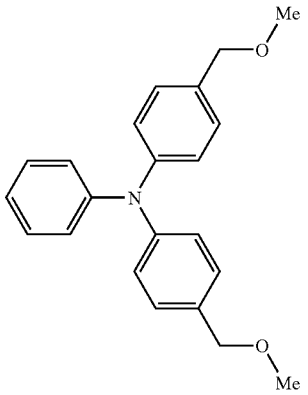

CONSTITUENT EXAMPLE 2

A solution is prepared by 20 parts by weight of acetylacetone zirconium butoxide (Orgatics ZC540, produced by Matsumoto Kosho Co., Ltd.), 2 parts by weight of γ-aminopropyltriethoxysilane (A1100, produced by Nippon Unicar Company Limited), 1.5 parts by weight of a polyvinylbutyral resin (S-LEC BM-S, produced by Sekisui Chemical Co., Ltd.) and 70 parts by weight of n-butylalcohol. The electroconductive substrate 121 formed of an aluminum pipe is dipped in the solution and coated by the solution, and then the solution is dried at 150° C. for 10 minutes to form an undercoat layer 122 having a film thickness of 0.9 μm.

A dispersion solution is prepared by dispersing 5 parts by weight of X-type non-metal phthalocyanine, 5 parts by weight of a vinyl-chloride-vinyl acetate copolymer (VMCH, produced by Union Carbide Corporation) and 200 parts by weight of n-butyl acetate for 2 hours in a sand mill using glass beads with a diameter of 1 mm. The undercoat layer 122 is dipped in the dispersion solution and is coated by the dispersion solution, and then the dispersion solution is dried at 100° C. for 10 minutes to form a charge generation layer 123 having a film thickness of 0.2 μm. it should be noted that the undercoat layer 122 and the charge generation layer 123 is the same as those in the constituent example 1.

A coating agent is prepared by dissolving 2 parts by weight of a charge transport compound represented by the following structural formula (II) and 3 parts by weight of a bisphenol Z polycarbonate resin (weight average molecular weight: 40,000) in 20 parts by weight of chlorobenzene. The coating agent is applied on the charge generation layer 123 by a dip coating method, and then the coating agent is heated at 110° C. for 40 minutes to form a charge transport layer 124 having a film thickness of 22 μm.

structural formula (II)

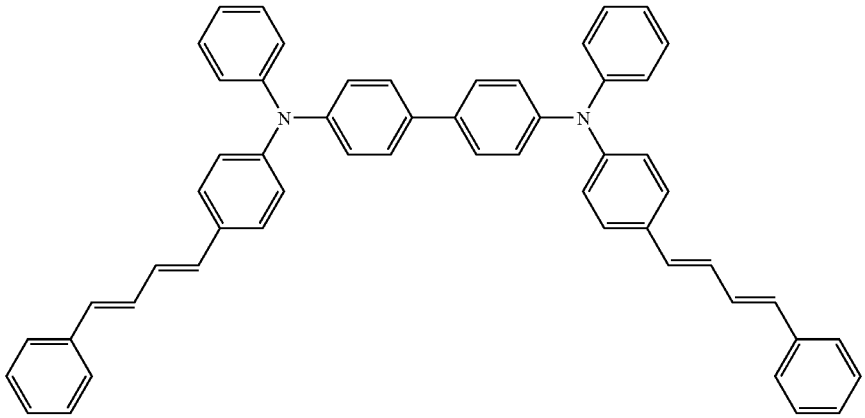

Following constituent materials are dissolved in 5 parts by weight of isopropyl alcohol, 3 parts by weight of tetrahydrofurane and 0.3 parts by weight of distilled water. The resultant solution is hydrolyzed by mixing with 0.5 parts by weight of an ion exchange resin (Amberlyst 15E) at room temperature for 24 hours with stirring.

[Constituent Materials]

A compound of the following structural formula (III): 2 parts by weight

Methyltrimethoxysilane: 2 parts by weight

Tetramethoxysilane: 0.3 parts by weight

Colloidal silica: 0.1 parts by weight

A fluorine graft polymer (ZX007C: produced by Fuji Kasei Kogyo Co., Ltd.): 0.5 parts by weight Then, a coating solution is prepared by adding 0.1 parts by weight of aluminum trisacetyl acetonate (Al (aqaq)3) and 0.4 parts by weight of 3,5-di-t-butyl-4-hydroxytoluene (BHT) to a solution which is obtained by filtering and separating the ion exchange resin from the hydrolyzed solution. The coating solution is applied on the charge transport layer 124 by a ring-type dip coating method and is air-dried at room temperature for 30 minutes, and then cured with heat at 170° C. for one hour to form an overcoat layer 125 having a film thickness of 4.0 μm.

structural formula (III)

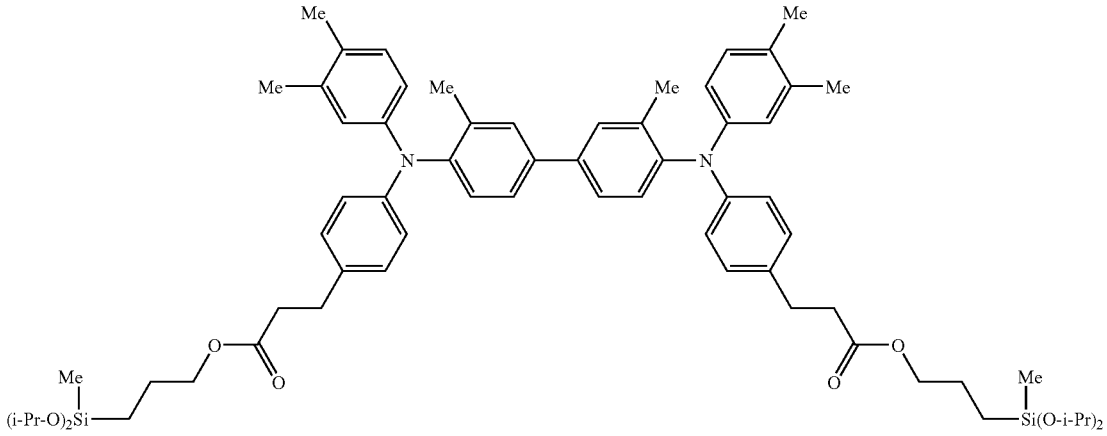

Figure 5:
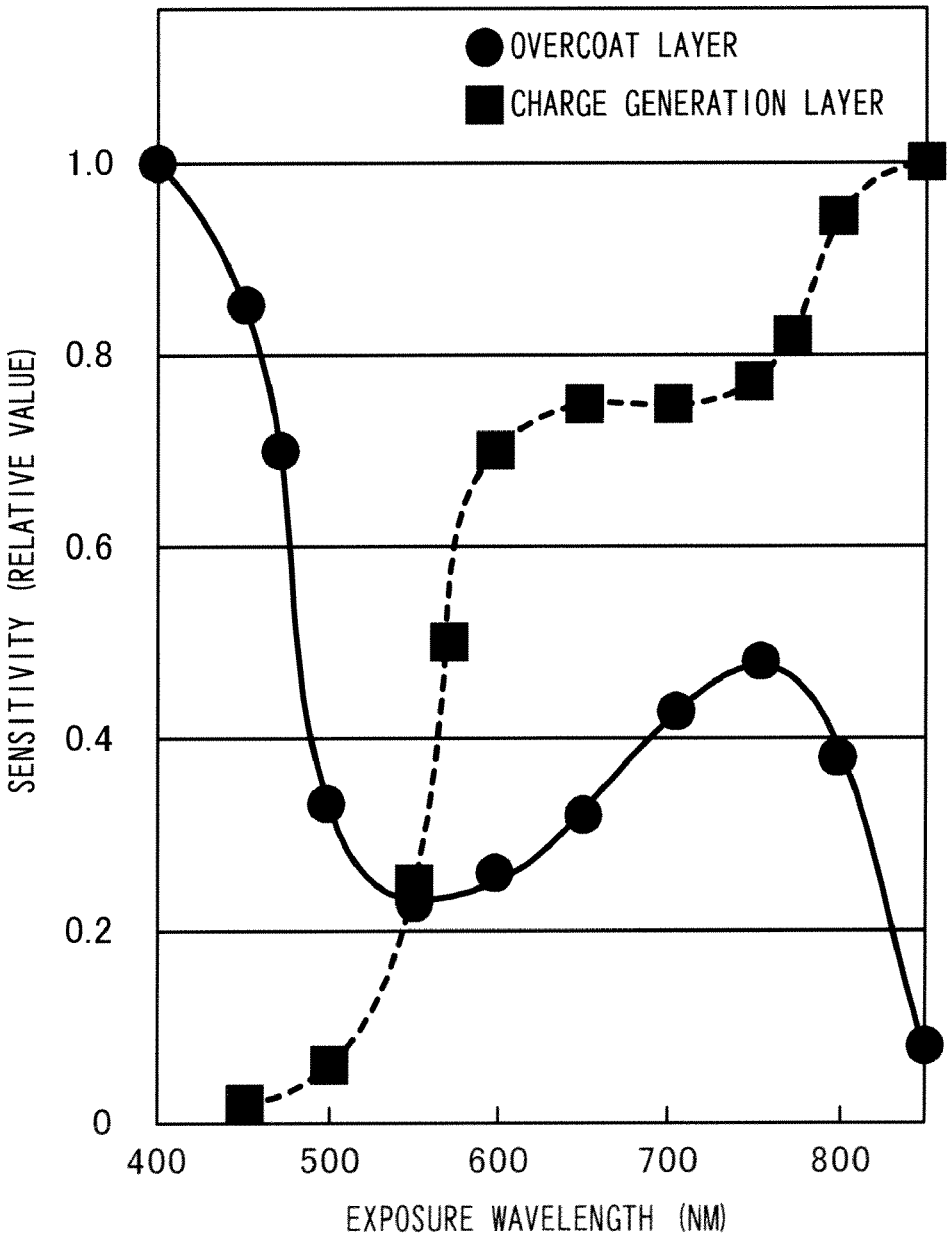
FIG. 5 is a graph chart showing a relationship between an exposure wavelength and respective sensitivities of the charge generation layer and the overcoat layer in the photoconductive layer.

FIG. 5 is a graph chart showing a relationship between an exposure wavelength and respective sensitivities of the charge generation layer 123 and the overcoat layer 125 in the photoconductive layer 126. In the graph chart, the horizontal axis represents the exposure wavelength (nm) and the vertical axis represents a relative value in which the sensitivity of the charge generation layer 123 or the overcoat layer 125 is normalized by each maximum sensitivity in the wavelength range of 400 nm to 850 nm (a predetermined wavelength range) shown in FIG. 5. It should be noted that "a relative value in which the sensitivity of the charge generation layer 123 or the overcoat layer 125 is normalized by each maximum sensitivity" refers to a relative value of the sensitivity when the maximum sensitivity is assumed to be 1.0. In addition, the constituent example 1 and the constituent example 2 differ in the composition of the overcoat layer 125, but both of them have almost similar optical properties.

In the first exemplary embodiment, as mentioned above, the oscillation wavelength of a laser light irradiated from the exposure unit 30 is 780 nm. For this reason, the charge generation layer 123 has a higher sensitivity to a wavelength of around 780 nm than a sensitivity to a wavelength range shorter than 780 nm. In addition, the charge generation layer 123 has a higher sensitivity to the wavelength range of 550 to 750 nm than in a sensitivity to the wavelength range of 500 nm or lower. On the other hand, the overcoat layer 125 has a higher sensitivity to the wavelength range of 500 nm or lower than a sensitivity to the wavelength range of more than 500 nm. That is, the wavelengths at which the charge generation layer 123 and the overcoat layer 125 have the maximum sensitivity are different.

It should be noted that the charge transport layer 124, unlike the charge generation layer 123 and the overcoat layer 125, has almost no sensitivity in the wavelength range of 400 to 850 nm.

Figure 6:
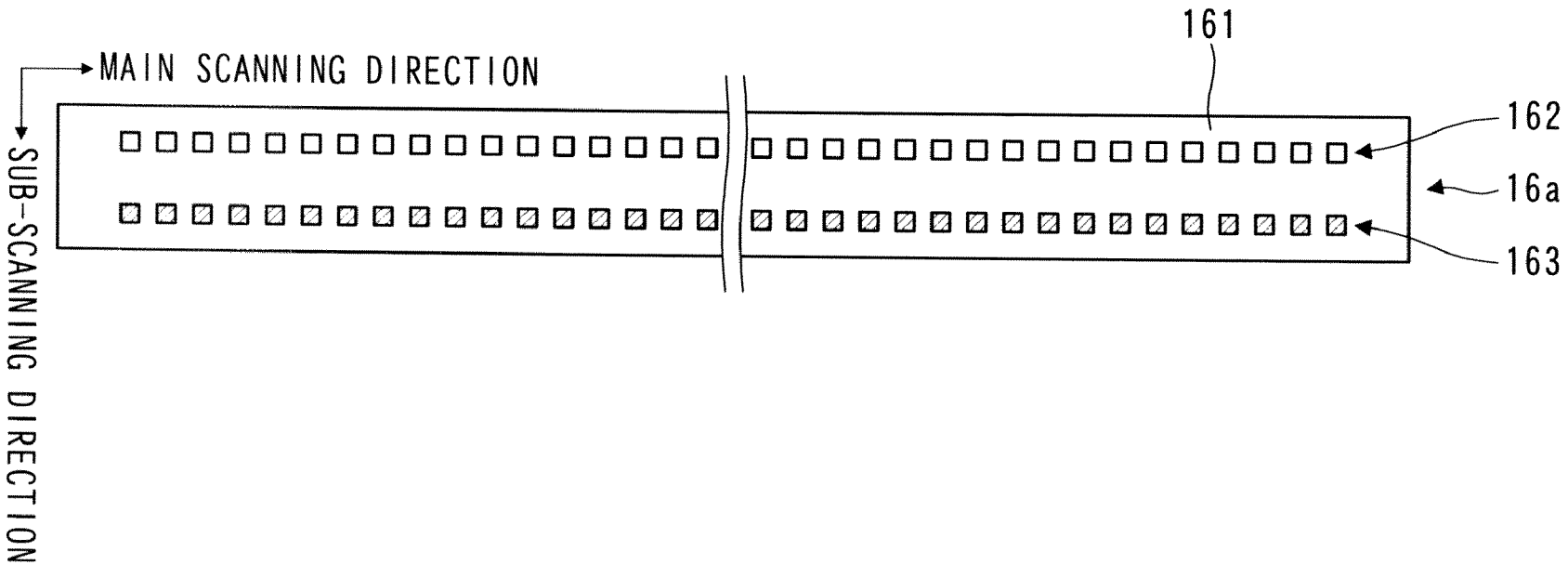
FIG. 6 is a view for explaining the configuration of the light emitting part in the light irradiation device.

FIG. 6 is a view for explaining the configuration of the light emitting part 16*a* in the light irradiation device 16.

The light emitting part 16*a* is provided with a substrate 161, an erasing light source 162 as an example of a light irradiation unit mounted on the substrate 161 and a light source for light-induced fatigue 163 as an example of other light irradiation units.

Among them, the erasing light source 162 is constituted by disposing multiple LEDs (Light Emitting Diode), which emit light with a wavelength of 650 nm, in the main scanning direction. In addition, the light source for light-induced fatigue 163 is constituted by disposing multiple LEDs (Light Emitting Diode), which emit light with a wavelength of 465 nm, in the main scanning direction. Therefore, the erasing light source 162 and the light source for light-induced fatigue 163 are arranged in parallel. Further, in the first exemplary embodiment, the light-emitting power supply 16*b* shown in FIG. 2 selectively supplies electric power for light emission to the erasing light source 162 or the light source for light-induced fatigue 163.

Next, a description will be given for the image forming operation by the printer 1. To an image processing unit (not shown in the figure), a color material reflection light image of the original document read by an original document reading device which is not shown in the figure and a color material image data formed by a personal computer or the like which are not shown in the figure are inputted as, for example, reflectance data of 8 bits for each of R (red), G (green) and B (blue). In the image processing unit, the inputted reflectance data is subjected to image processing such as various image editions and the like including shading correction, position displacement correction, brightness/color space correction, gamma correction, frame erasing or color edition, movement edition, and the like. The image data subjected to the image processing are converted into color material gradation data of four colors which are yellow (Y), magenta (M), cyan (C) and black (K), and outputted to the exposure unit 30.

In the exposure unit 30, a laser light for each color outputted from a laser diode (not shown in the figure) is outputted to a polygon mirror (not shown in the figure) through a f-θ lens (not shown in the figure) according to the inputted color material gradation data. In the polygon mirror, the incident laser light of each color is deflectively scanned and the photoconductor drums 12 of the image forming parts 11Y, 11M, 11C and 11K is irradiated through the image forming lens and multiple mirrors which are not shown in the figure. In the photoconductor drum 12 of each of the image forming parts 11Y, 11M, 11C and 11K, the surface charged by the charging device 13 is scanned and exposed, and a certain electrostatic latent image is formed. The electrostatic latent image formed on the photoconductor drum 12 is developed as a toner image of each color of yellow (Y), magenta (M), cyan (C) and black (K) in the development device 14 of each of the image forming parts 11Y, 11M, 11C and 11K.

The toner images formed on the photoconductor drums 12 of the image forming parts 11Y, 11M, 11C and 11K are sequentially transferred on the intermediate transfer belt 21 by the primary transfer device 15 provided to the corresponding image forming parts 11Y, 11M, 11C and 11K. In addition, the photoconductor drum 12 after the primary transfer is erased by the light irradiation device 16 and then the remaining toner and the like are removed by the photoconductor cleaner 17 to be ready for the next charging.

On the other hand, in the paper sheet transportation unit 40, the pick-up roll 42 is rotated by adjusting to the timing of image formation and the paper sheet P is taken out from the paper sheet stacking part 41. The paper sheet P separated one by one by the separation rolls 43 is transported to the registration roll 45 through the transporting path 44 and is once stopped. Thereafter, the registration roll 45 is rotated by adjusting to the transportation timing of the intermediate transfer belt 21 on which the toner images are superimposed and transferred, and then the paper sheet P is transported to the secondary transfer position formed by the back-up roll 24 and the secondary transfer roll 46. On the paper sheet P transported to the secondary transfer position, the toner images that have been superimposed and transferred are secondarily transferred in sequence in the sub-scanning direction by crimping force and a predetermined electric field. Further, the paper sheet P on which the toner images have been secondarily transferred is subjected to a fixing treatment with heat and pressure by the fixing unit 29, and then is outputted to the outputted paper sheet stacking part 48 provided on the upper portion of the printer 1, by the exit roll 47. It should be noted that, in the intermediate transfer belt 21 after the secondary transfer, remaining toner is removed by the belt cleaner 25 to be ready for the primary transfer.

Figure 7:
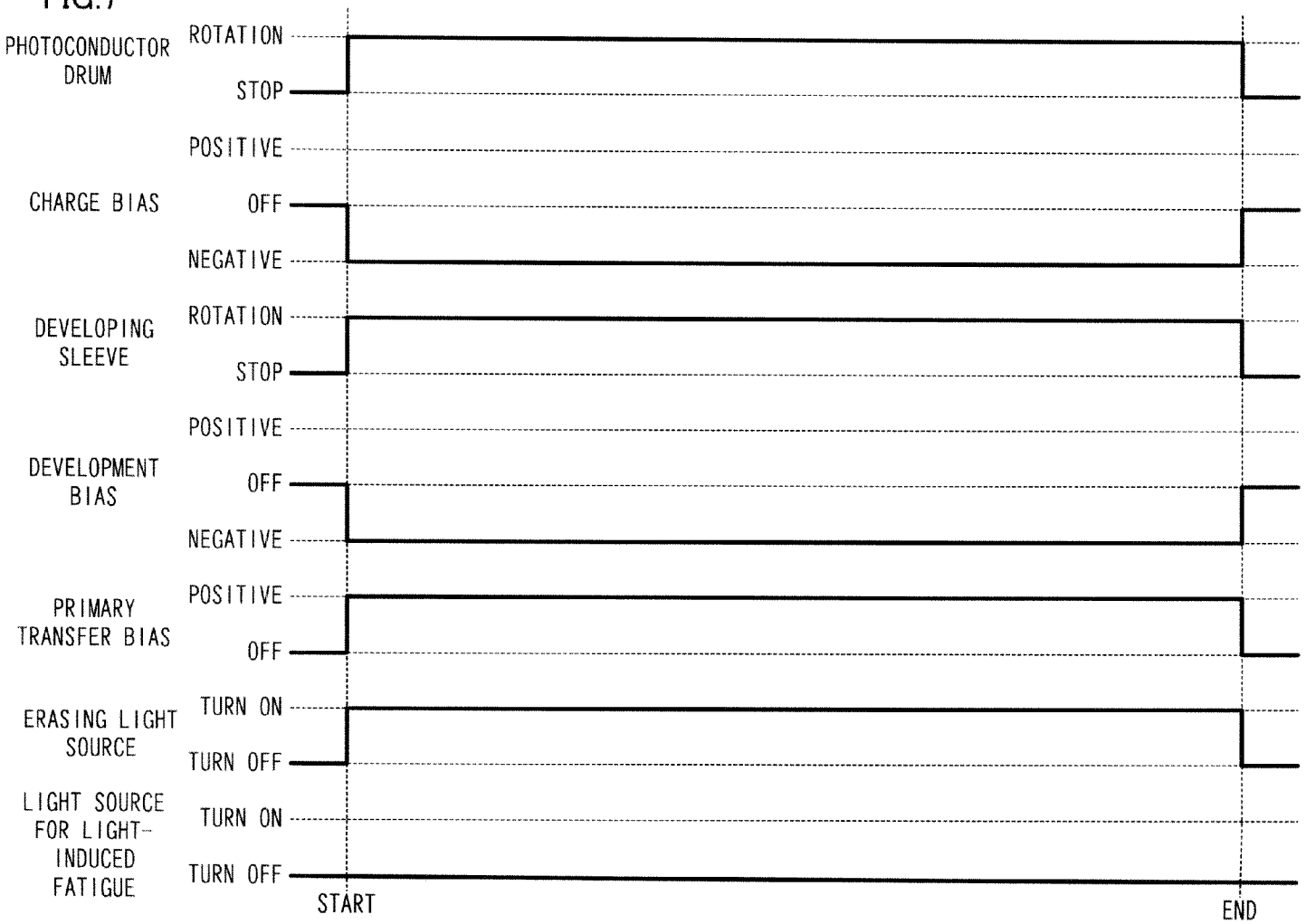
FIG. 7 is a timing chart for explaining the operation of the image forming parts in the image forming operation.

Here, a detailed description will be given for the operation of the image forming parts 11Y, 11M, 11C and 11K in the image forming operation with reference to a timing chart shown in FIG. 7.

The controller 50 receiving the start instruction of image formation outputs control signals to the drum driving motor 12*a*, the charging power supply 13*b*, the sleeve driving motor 14*d*, the developing power supply 14*e*, the primary transfer power supply 15*b* and the light-emitting power supply 16*b*. After receiving the control signals, the drum driving motor 12*a* rotatably drives the photoconductor drum 12 at a predetermined peripheral speed. In addition, the charging power supply 13*b* applies a negative charge bias to the charging roll 13*a* so that the charge potential of the photoconductive layer 126 of the photoconductor drum 12 is −720 V (negative polarity). Further, the sleeve driving motor 14*d* drives the developing sleeve 14*a* at a predetermined peripheral speed, and the developing power supply 14*e* applies, to the developing sleeve 14*a*, a development bias in which a rectangular wave having an amplitude (peak-to-peak value) of 1.0 kV, a frequency of 6 kHz and a duty ratio of 60% is superimposed on a direct current component of −580 V (negative polarity). Furthermore, the primary transfer power supply 15*b* applies a primary transfer bias with positive polarity to the primary transfer roll 15*a*. The light-emitting power supply 16*b* supplies electric power for light emission to the erasing light source 162.

In the photoconductor drum 12 to which a negative charge bias is applied by the charging roll 13*a*, a negative charge is maintained on the surface of the overcoat layer 125 constituting the photoconductive layer 126, and, as a result, it is charged at −720 V. Then, with a laser light having a wavelength of 780 nm, the exposure unit 30 selectively irradiates the photoconductive aver 126 of the photoconductor drum 12 which is charged at −720 V. Here, with reference to FIG. 5, the charge generation layer 123 constituting the photoconductive layer 126 has a high sensitivity to the exposure wavelength of 780 nm. For this reason, at a portion in the photoconductive layer 126, which is irradiated with the laser light, charge pairs including positive and negative charges are generated in the charge generation layer 123. Then, the generated positive charges are moved from the charge generation layer 123 to the overcoat layer 125 through the charge transport layer 124 by the influence of the electric field, and the positive charges combine with the negative charges on the overcoat layer 125 to disappear. On the other hand, the generated negative charges are moved from the charge generation layer 123 to the electroconductive substrate 121 through the undercoat layer 122 by the influence of the electric field. As a result, while potential at an image region of the photoconductive layer 126 which is irradiated with laser light, that is, the potential at an exposure portion, is reduced to −300 V, potential of a background region which is not irradiated with laser light is maintained at nearly −720 V. In this manner, an electrostatic latent image including the image region and the background region is formed on the photoconductive layer 126 of the photoconductor drum 12. It should be noted that, as is clear from FIG. 5, the overcoat layer 125 constituting the photoconductive layer 126 has a lower sensitivity to the exposure wavelength of 780 nm. For this reason, when the photoconductLve layer 126 is irradiated with light by using the exposure unit 30, almost no charge pair is generated in the overcoat layer 125. Therefore, in the exposure process, the photoconductive layer 126 is irradiated with a light with a wavelength at which charge pairs are generated more readily in the charge generation layer 123 than in the overcoat layer 125.

In the development device 14, as mentioned above, a development bias in which an alternating current of 1.0 kV (peak-to-peak value) is superimposed on the direct current of −580 V is applied to the developing sleeve 14*a*. For this reason, the image region (−300 V) on the photoconductive layer 126 of the photoconductor drum 12 is relatively positive (+280 V) to the developing sleeve 14*a*. On the other hand, the background region (−720V) on the photoconductive layer 126 is relatively negative (−140 V) to the developing sleeve 14*a*. For this reason, while the toner held in the developing sleeve 14*a* in a negatively charged state is electrostatically transferred to the image region of the photoconductive layer 126, it is unlikely to be transferred to the background region. Thus, a toner image corresponding to the image region is developed on the photoconductor drum 12.

In the primary transfer device 15, as mentioned above, the primary transfer bias of positive polarity is applied to the primary transfer roll 15*a*. Therefore, the toner attached to the photoconductive layer 126 of the photoconductor drum 12 in a negatively charged state is electrostatically transferred to the intermediate transfer belt 21 by the influence of the electric field. Thus, a toner image is transferred to the intermediate transfer belt 21 from the photoconductor drum 12. It should be noted that, the negative charge constituting the electrostatic latent image formed by the charge and the exposure remains on the photoconductive layer 126 even after the photoconductive layer 126 passes through a portion opposed to the primary transfer roll 15*a*.

Since the electric power is supplied to the erasing light source 162 in the light irradiation device 16, the erasing light source 162 is turned on and the light source for light-induced fatigue 163 is turned off. For this reason, with the light having a wavelength of 650 nm, the whole region of the photoconductive layer 126 of the photoconductor drum 12 is irradiated after the primary transfer. Here, with reference to FIG. 5, the overcoat layer 125 constituting the photoconductive layer 126 has a low sensitivity to the light having a wavelength of 650 nm. For this reason, almost no charge pair is generated in the overcoat layer 125 even if the photoconductive layer 126 is irradiated with the light by using the erasing light source 162. In addition, with reference to FIG. 5, the charge generation layer 123 constituting the photoconductive layer 126, unlike the overcoat layer 125, has a high sensitivity to the exposure wavelength of 650 nm. For this reason, charge pairs including positive and negative charges are generated in the charge generation layer 123 by the light irradiation to the photoconductive layer 126 by using the erasing light source 162. Then, the generated positive charges are moved from the charge generation layer 123 to the overcoat layer 125 through the charge transport layer 124 by the influence of the electric field, and combine with the negative charges remaining on the overcoat layer 125 to disappear. On the other hand, the generated negative charges are moved from the charge generation layer 123 to the electroconductive substrate 121 through the undercoat layer 122 by the influence of the electric field. As a result, the charge potential of the photoconductive layer 126 is uniformly decreased and erasing is performed.

Further, the photoconductive layer 126 of the photoconductor drum 12 is cleaned by the photoconductor cleaner 17 after the erasing by the erasing light source 162 and is charged again at −720 V by the charging roll 13*a*. Subsequently, the toner image is formed and transferred by repeating the above-described procedure.

Thereafter, when the image forming operation is completed, the controller 50 outputs control signals to the drum driving motor 12*a*, the charging power supply 13*b*, the sleeve driving motor 14*d*, the developing power supply 14*e*, the primary transfer power supply 15*b* and the light-emitting power supply 16*b*. After receiving the control signals, the drum driving motor 12*a* stops the driving of the photoconductor drum 12. In addition, the charging power supply 13*b* stops the application of the charge bias to the charging roll 13*a*. Further, the sleeve driving motor 14*d* stops the driving of the developing sleeve 14*a*, and the developing power supply 14*e* stops the application of the development bias to the developing sleeve 14*a*. Furthermore, the primary transfer power supply 15*b* stops the application of the primary transfer bias to the primary transfer roll 15*a*. Then, the light-emitting power supply 16*b* stops the supply of electric power for light emission to the erasing light source 162.

Meanwhile, in the printer 1, the image forming cartridge 60 shown in FIG. 3 is replaced where necessary. In addition, for example, in the case of performing maintenance operations, the image forming cartridge 60 may be removed from the printer 1, and the image forming cartridge 60 may be mounted again on the printer 1 after the operation.

In the first exemplary embodiment, after the image forming cartridge 60 is mounted on the printer 1 in this manner, a setup operation for image adjustment is to be executed.

Figure 8:
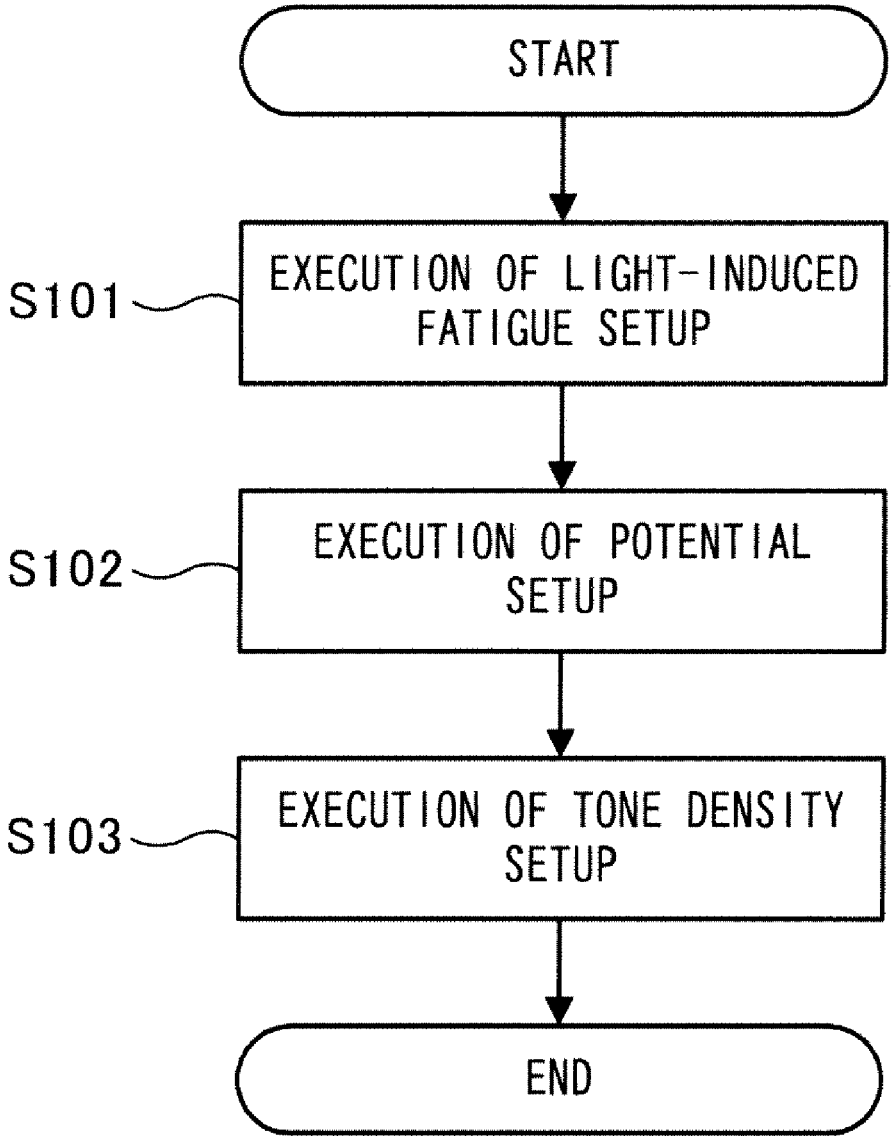
FIG. 8 is a flowchart showing a procedure of a setup operation.

FIG. 8 is a flowchart showing a procedure of a setup operation. It should be noted that, the processing is performed when a sensor and the like (not shown in the figure) detect the mounting of the image forming cartridge 60 on the printer 1.

The controller 50 firstly causes execution of a light-induced fatigue setup in which the overcoat layer 125 constituting the photoconductive layer 126 of the photoconductor drum 12 of the mounted image forming cartridge 60 is uniformly light-induced-fatigued (Step 101). The light-induced fatigue setup will be described later in detail. When the light-induced fatigue setup is completed, the controller 50 then causes execution of a potential setup (Step 102). In the potential setup, the charging roll 13*a* adjusts the charge potential of the photoconductor drum 12, and the exposure unit 30 adjusts the potential of the exposure portion. When the potential setup is completed, the controller 50 further causes execution of a tone density setup (Step 103), and a series of the processings is completed. It should be noted that, in the tone density setup, the density and tone corrections of the toner image formed on the photoconductor drum 12 are performed.

Figure 9:
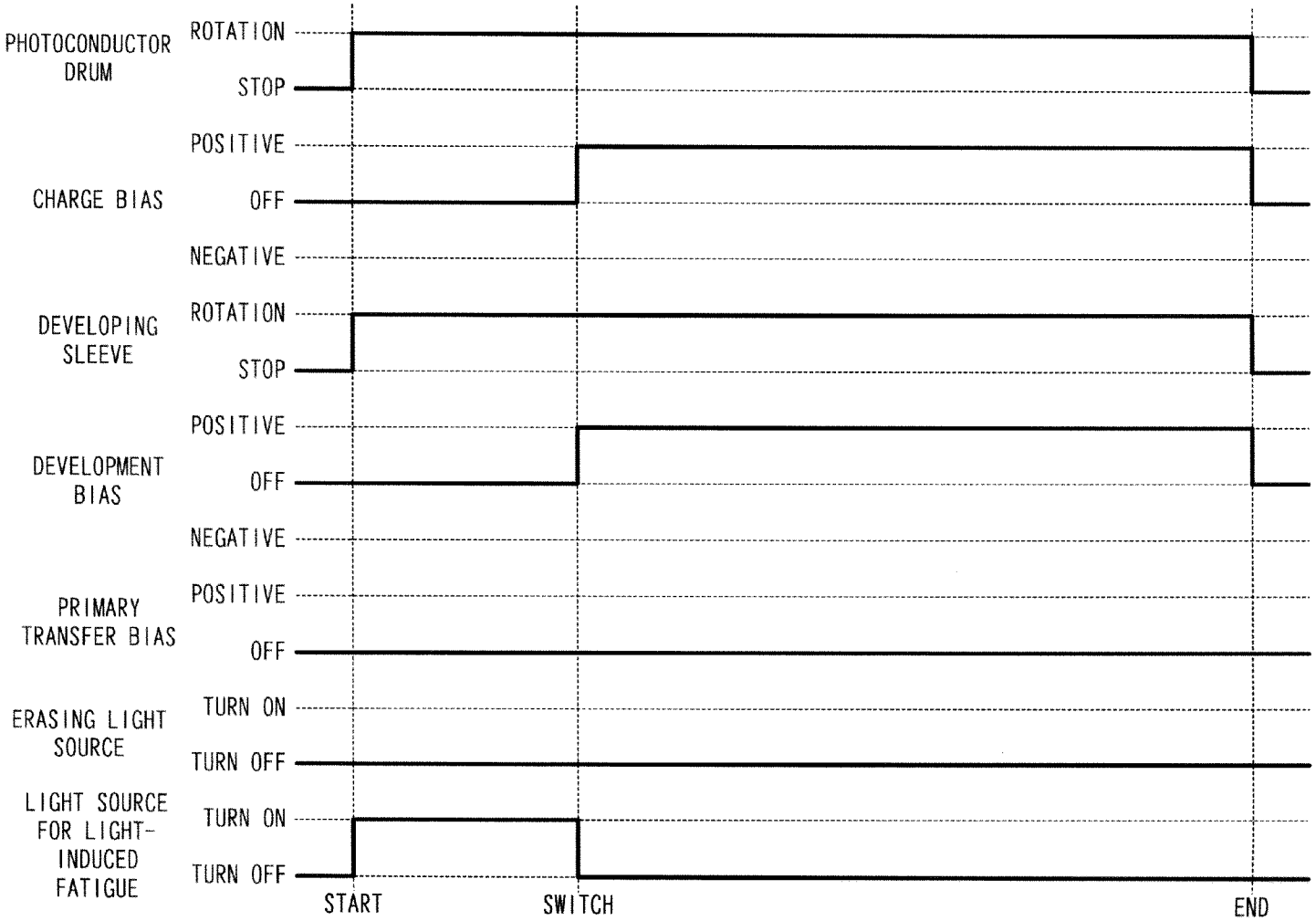
FIG. 9 is a timing chart for explaining the operation of the image forming parts in the light-induced fatigue setup.

Then, a detailed description will be given for operation of the image forming parts 11Y, 11M, 11C and 11K in the above-mentioned light-induced fatigue setup with reference to a timing chart shown in FIG. 9.

The controller 50 receiving the start instruction of the light-induced fatigue setup outputs control signals to the drum driving motor 12*a*, the sleeve driving motor 14*d* and the light-emitting power supply 16*b*. After receiving the control signals, the drum driving motor 12*a* rotatably drives the photoconductor drum 12 at a predetermined peripheral speed. In addition, the sleeve driving motor 14*d* drives the developing sleeve 14*a* at a predetermined peripheral speed. The light-emitting power supply 16*b* supplies electric power for light emission to the light source for light-induced fatigue 163. Further, in the light-induced fatigue setup, the controller 50 outputs control signals to the driving roll 22 to rotate the intermediate transfer belt 21. It should be noted that, at the start of the setup, the controller 50 does not outputs control signals to the charging power supply 13*b*, the developing power supply 14*e* and the primary transfer power supply 15*b*. For this reason, the photoconductor drum 12 rotates in a state without being subjected to charging by the charging roll 13*a*, exposure by the exposure unit 30, the application of the development bias by the developing sleeve 14*a* and the application of the primary transfer bias by the primary transfer roll 15*a*.

Since the electric power is supplied to the light source for light-induced fatigue 163 in the light irradiation device 16, the light source for light-induced fatigue 163 is turned on and the erasing light source 162 is turned off. Therefore, the photoconductive layer 126 of the photoconductor drum 12 is irradiated with the light having a wavelength of 465 nm. Here, with reference to FIG. 5, the overcoat layer 125 constituting the photoconductive layer 126 has a high sensitivity to the exposure wavelength of 465 nm. For this reason, charge pairs including positive and negative charges are generated on the overcoat layer 125 by light irradiation to the photoconductive layer 126 by using the light source for light-induced fatigue 163. On the other hand, with reference to FIG. 5, the charge generation layer 123 constituting the photoconductive layer 126 has a low sensitivity to the exposure wavelength of 465 nm. For this reason, when the photoconductive layer 126 is irradiated with light by using the light source for light-induced fatigue 163, almost no charge pair is generated in the charge generation layer 123. Therefore, in the light irradiation process, the photoconductive layer 126 is irradiated with a light which has a wavelength at which charge pairs are generated more readily on the overcoat layer 125 than on the charge generation layer 123.

In this manner, in the first process of the light-induced fatigue setup, a light irradiation operation with the light having a wavelength of 465 nm by using the light source for light-induced fatigue 163 is performed on the rotating photoconductor drum 12.

After a predetermined time has passed since the photoconductor drum 12 is rotated at least once, more preferably several or more times from the start of the light-induced fatigue setup, the controller 50 outputs control signals to the charging power supply 13*b*, the developing power supply 14*e* and the light-emitting power supply 16*b*. After receiving the control signals, the charging power supply 13*b* applies a positive charge bias (reverse charge bias) to the charging roll 13*a* so that the charge potential of the photoconductive layer 126 is +860 V (positive polarity). In addition, the developing power supply 14*e* applies a positive development bias (reverse development bias) including a direct current component of +1000 V (positive polarity) to the developing sleeve 14*a*. Further, the light-emitting power supply 16*b* stops the supply of electric power for light emission to the light source for light-induced fatigue 163. It should be noted that, at this time, the light-emitting power supply 16*b* does not supply electric power for light emission to the erasing light source 162.

In the photoconductor drum 12 to which a positive charge bias is applied by the charging roll 13*a*, a positive charge is maintained on the surface of the overcoat layer 125 constituting the photoconductive layer 126, and as a result, it is charged at +860 V. The exposure unit 30 does not irradiate, with a laser light, the photoconductive layer 126 of the photoconductor drum 12 which is charged at +860 V. Therefore, the photoconductive layer 126 is moved to the portion opposed to the developing sleeve 14*a* in a state where the photoconductive layer 126 is charged at +860 V.

In the development device 14, a reverse development bias of +1000 V with direct current is applied to the developing sleeve 14*a*, as mentioned above. For this reason, the whole region (+860 V) of the photoconductive layer 126 of the photoconductor drum 12 is relatively negative (−140 V) to the developing sleeve 14*a*. Therefore, the toner held in the developing sleeve 14*a* in a negatively charged state is not transferred to the photoconductive layer 126. Thus, the toner image is not developed on the photoconductor drum 12.

In the primary transfer device 15, the primary transfer bias is not applied to the primary transfer roll 15*a*. Therefore, the potential of +860 V remains as is on the photoconductive layer 126 even after the photoconductive layer 126 passes through the portion opposed to the primary transfer roll 15*a*.

Since the electric power is not supplied to both the erasing light source 162 and the light source for light-induced fatigue 163 in the light irradiation device 16, both the erasing light source 162 and the light source for light-induced fatigue 163 are turned off.

In this manner, the second process of the light-induced fatigue setup, the reverse charging operation using the charging roll 13*a* is performed on the rotating photoconductor drum 12.

When a predetermined time passes from the start of the application of the reverse charge bias, the controller 50 outputs control signals to the drum driving motor 12*a*, the charging power supply 13*b*, the sleeve driving motor 14*d* and the developing power supply 14*e*. After receiving the control signals, the drum driving motor 12*a* stops the driving of the photoconductor drum 12. In addition, the charging power supply 13*b* stops the application of the reverse charge bias to the charging roll 13*a*. Further, the sleeve driving motor 14*d* stops the driving of the developing sleeve 14*a*, and the developing power supply 14*e* stops the application of the reverse development bias to the developing sleeve 14*a*.

Thereafter, the positive charge on the photoconductive layer 126 is uniformly attenuated with the elapse of time.

Here, a description will be given for the reason for executing the above-mentioned light-induced fatigue setup.

When the image forming cartridge 60 is mounted on the printer 1, the image forming cartridge 60 before mounting on the printer 1 is to be temporarily placed at an outside. At this time, the image forming cartridge 60 is preferably stored by, for example, being covered with a sheet having a light shielding property, but the image forming cartridge 60 may be left as is. Here, as is clear from FIG. 3, in the photoconductor drum 12 constituting the image forming cartridge 60, there exist one region which is covered with a housing of the charging roll 13*a* and the photoconductor cleaner 17, and the other region which is exposed outside without being covered with the housing. For this reason, if the image forming cartridge 60 is not covered with a sheet or the like and is left as is, the region exposed outside in the photoconductor drum 12 is selectively exposed to external light. As a result, there occurs a difference in the degree of light-induced fatigue of the photoconductive layer 126 between the region which is exposed to the external light and the region which is not exposed to the external light, in the photoconductor drum 12. Accordingly, the variation in density occurs when the image forming operation is performed.

In particular, in the first exemplary embodiment, as shown in FIG. 5, the overcoat layer 125 constituting the photoconductive layer 126 has a relatively high sensitivity to a wavelength range of 400 to 500 nm, light-induced fatigue is likely to occur when the overcoat layer 125 is exposed to light in this wavelength range. The light-induced fatigue occurred at the overcoat layer 125 is more difficult to be reduced than the light-induced fatigue occurred at the charge generation layer 123, and the influence of the variation in density remains over a long period of time.

Here, a description will be given for factors of the occurrence of unevenness of an image caused by the light-induced fatigue of the overcoat layer 125, based on experiments conducted by the present inventors.

The present inventors perform light irradiation using a general three-wavelength type daylight fluorescent lamp so that the illuminance is 600 lx on the photoconductor drum 12 constituting the image forming cartridge 60. Here, if the irradiation time is approximately one minute, even when a half-tone image (the density of 20%: hereinafter the same) is formed by mounting the image forming cartridge 60 after the light irradiation, on the printer 1, no difference in density between a light exposure region and a non light exposure region of the photoconductive layer 126 Is observed. However, when the irradiation time is three minutes and a half-tone image is formed by mounting the image forming cartridge 60 after the light irradiation, on the printer 1, a difference in density between the light exposure region and the non light exposure region of the photoconductive layer 126 is observed. At this time, there has occurred a phenomenon in which the density of the light exposure region is decreased relative to the non light exposure region when the peripheral speed of the photoconductor drum 12 at the time of image forming operation is set to 52 mm/sec, and the density of the light exposure region is increased relative to the non light exposure region when the peripheral speed is set to 165 mm/sec. Further, when the irradiation time is set to 10 minutes and a half-tone image is formed by mounting the image forming cartridge 60 after the light irradiation, on the printer 1, the density of the light exposure region is decreased relative to the non light exposure region, in both of the case where the peripheral speed of the photoconductor drum 12 at the time of image forming operation is set to 52 mm/sec and the case where the peripheral speed is set to 165 mm/sec. It should be noted that, if the photoconductor drum 12 having no overcoat layer 125 is used, no difference in density due to light exposure is observed even when the irradiation time is three minutes.

Here, from the above-mentioned reasons, it is inferred that the difference in density between the light exposure region and the non light exposure region results from the light-induced fatigue of the overcoat layer 125.

In addition, from the experimental results, it is inferred that, in the overcoat layer 125, the increase in density due to the increase in response and the decrease in density due to the flow of charges in the face direction simultaneously occur according to irradiation of light to which the overcoat layer 125 has a sensitivity. If the overcoat layer 125 is irradiated with light having a wavelength of 400 to 500 nm, charge pairs having positive and negative charges are generated in the overcoat layer 125. Here, the generated positive charges, that is, some holes are captured by the traps in the overcoat layer 125. In the non light exposure region, carriers are moved while captured by the traps, but the traps captures holes. Therefore, the response at the time of exposure is increased because the hole transfer speed from the charge transport layer 124 is apparently increased, thus resulting in the increase in the density of the toner image to be developed. On the other hand, if the overcoat layer 125 is excessively irradiated with light having a wavelength of 400 to 500 nm, here exist a large number of holes which may not be captured by the traps in the overcoat layer 125. Since these holes may move freely in the overcoat layer 125, a charge easily flows in the face direction, and especially when printing is performed at a low speed, the density of the toner image to be developed is resultantly decreased.

The present inventors consider to address the problem and find that the variation in density may be improved by charging the photoconductor drum 12 with a polarity opposite to a normal charging polarity (a positive polarity in the first exemplary embodiment) for a certain period of time, that is, by charging the overcoat layer 125 constituting the photoconductive layer 126 to a positive polarity. In this experiment, the photoconductor drum 12 which is charged at −720 V (negative polarity) in a typical image forming operation is partially irradiated with light for three minutes at 600 l× by using the three-wavelength type daylight fluorescent lamp, and then the photoconductor drum 12 is rotated for five minutes at a peripheral speed of 52 mm/sec while being charged at +1000 V (positive polarity). Thereafter, the image forming cartridge 60 which has been reversely charged is mounted on the printer 1 and a half-tone image is formed at a peripheral speed of 52 mm/sec. Then, no difference in density between the light exposure region and the non light exposure region is observed. However, when the image forming cartridge 60 which has been also reversely charged is mounted on the printer 1 and a half-tone image is formed at a peripheral speed of 165 mm/sec, there consistently occurs a phenomenon in which the density of the light exposure region is increased relative to the non light exposure region. On the other hand, no such phenomenon is observed even when the image forming cartridge 60 is highly charged to the normal polarity (−1500 V) after the light exposure.

From the results, it may be inferred that the holes which exist and freely move in the overcoat layer 125 may be erased by reversely charging the photoconductive layer 126 (the overcoat layer 125) of the photoconductor drum 12. In addition, it is found that the flow of charges in the face direction is suppressed and, as a result, the decrease in density is suppressed. That is, by reversely charging the photoconductive layer 126, the region in which a large number of holes freely moving by excessive light exposure exist is returned to a state where the holes are captured by the traps.

In order to further increase the response in the light exposure region based on the above experiments and consideration, the present inventors make response increase in the whole area by irradiating the whole region of the photoconductor layer 126 constituting the photoconductor drum 12 with light having a wavelength to which the overcoat layer 125 has a sensitivity to cause uniform light-induced fatigue in the overcoat layer 125. Then, after the uniform light-induced fatigue of the overcoat layer 125, the whole region of the photoconductor layer 126, that is, the whole region of the overcoat layer 125, is charged to a polarity that is opposite to the normal charging polarity so as to be in a similar light exposure state. This is in a state in which excessive charges freely moving in the overcoat layer 125 are erased and the flow of the charges in the face direction is suppressed. At this time, since the traps in the overcoat layer 125 captures holes, the light response is uniformly increased.

Then, a description will be given for the evaluation tests carried out for reaching the above described configuration and their evaluation results.

FIG. 10 is a table showing the list of the conditions and results in the evaluation tests.

In the evaluation tests, firstly, the photoconductor drum 12 attached to the image forming cartridge 60 is irradiated with light for three minutes at 600 l× by using the three-wavelength type daylight fluorescent lamp. As a result, on the photoconductor drum 12, a light exposure region which is exposed to the outside and a non light exposure region which is not exposed to the outside are formed. Subsequently, the image forming cartridge 60 is mounted on the printer 1, and 20% and 50% half-tone images are respectively formed by rotating at a peripheral speed of 52 mm/sec.

Here, in a sample S1, the photoconductive layer 126 (the overcoat layer 125) is irradiated with light having a wavelength of 465 nm for one minute by using the light source for light-induced fatigue 163 before starting the image forming operation. Thereafter, the reverse charge bias is applied for three minutes by using the charging roll 13*a* so that the surface potential of the photoconductor drum 12 is +860 V. Further, while the reverse charge bias is applied by using the charging roll 13*a*, the reverse development bias of +1000 V is applied to the developing sleeve 14*a*.

In addition, in a sample S2, the test is carried out under almost the same conditions as in the sample 1, however, the reverse charge bias is applied for 5 minutes.

Further, in a sample S3, the test is carried out under almost the same conditions as in the sample 1. However, the reverse charge bias is applied by using the charging roll 13*a* so that the surface potential of the photoconductor drum 12 is +1360 V. Furthermore, while the reverse charge bias is applied by using the charging roll 13*a*, the reverse development bias of +1500 V is applied to the developing sleeve 14*a*.

On the other hand, in a sample S4, the image forming operation is directly started without the light irradiation by the light source for light-induced fatigue 163, the application of the reverse charge bias by the charge roll 13*a* and the application of the reverse development bias before starting the image forming operatlon.

In addition, in a sample S5, only the light Irradiation by the light source for light-induced fatigue 163 is performed, compared to the conditions of the sample S4.

Further, in a sample S6, only the reverse charge bias (+860 V) and the related reverse development bias (+1000 V) to the developing sleeve 14*a* are applied, compared to the conditions of the sample S4.

It should be noted that, the peripheral speed of the photoconductor drum 12 before the start of the image forming operation is set to 52 mm/sec, which is the same at the time of the image forming operation.

As a result, in the samples S1 to S3 which are reversely charged after the light-induced fatigue of the overcoat layer 125 of the photoconductor drum 12, the unevenness of an image is confirmed to be reduced (result A: the unevenness of an image is not recognized or result B: the unevenness of an image is hardly recognized) In particular, in the sample S2 in which the application time of the reverse charge bias is extended compared to the application time of the sample S1 and in the sample S3 in which the reverse charge bias is higher compared to the reverse charge of the sample S11 extremely favorable results (result A: the unevenness of an image is not recognized) are obtained. This is considered to be caused by the increase in the charge amount per unit area supplied to the overcoat layer 125 by the reverse charge.

On the other hand, in the sample S4 in which the light-induced fatigue and reverse charge of the overcoat layer 125 are not performed and in the sample S5 in which only the light-induced fatigue is performed, it is found that the unevenness of an image is hardly improved (result D: the unevenness of an image is clearly recognized) In addition, in the sample S6 in which only the reverse charge of the overcoat layer 125 is performed, it is found that the unevenness of an image is improved compared to those of the samples S4 and S5, but the improvement level of the unevenness of an image is low compared to those of the samples S1 to S3 because the high density in the light exposure region is not improved (result C: the unevenness of an image is slightly recognized).

Second Exemplary Embodiment

Figure 11:
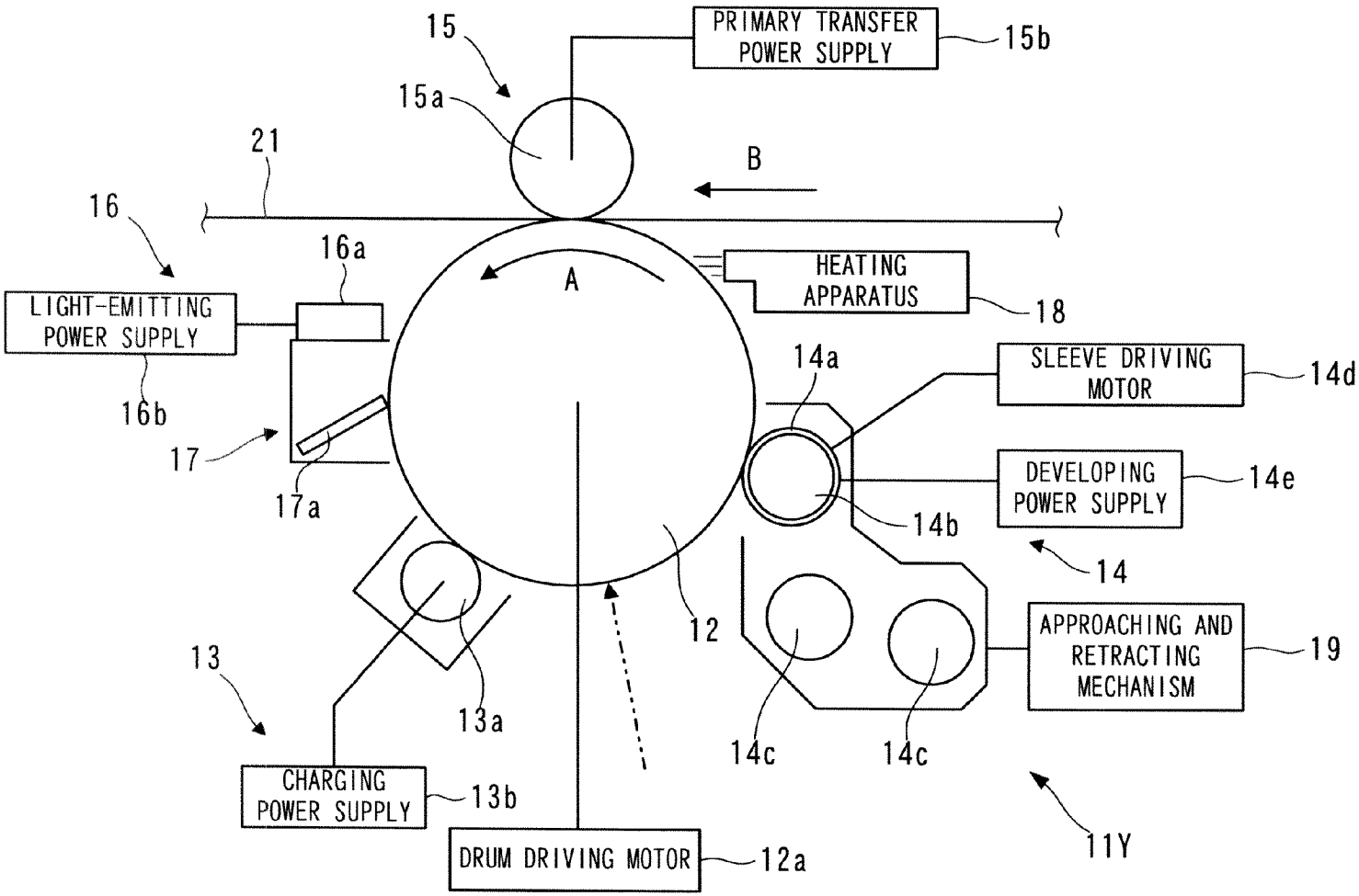
FIG. 11 is a view for explaining a configuration of the image forming part for yellow used in the second exemplary embodiment.

FIG. 11 is a view for explaining a configuration of the image forming part 11Y for yellow used in the second exemplary embodiment. It should be noted that the image forming part 11Y for yellow is taken here as an example. However, each of the image forming parts 11M, 11C and 11K for other colors has the same configuration except for used color toner.

The basic configuration of the image forming part 11Y for yellow is basically the same as that explained in the first exemplary embodiment. However, the second exemplary embodiment is different from the first exemplary embodiment in which the charging power supply 13*b* supplies only a negative charge bias but supplies no positive charge bias to the charging roll 13*a* and a heating apparatus 18 as an example of an erasing unit and a heating unit is provided between the development device 14 and the primary transfer device 15, and the development device 14 is provided with an approaching and retracting mechanism 19. In consideration of the influence on toner on the development roll of the development device 14, as mentioned later, the installation position of the heating apparatus 18 is preferably on the downstream side of the development device 14 and at the upstream side of the primary transfer device 15 viewed from the rotation direction of the photoconductor drum 12.

In the second exemplary embodiment, the heating apparatus 18 is provided with, for example, a heating wire and a fan, and has a function of heating the photoconductive layer 126 (the overcoat layer 125) on the photoconductor drum 12 to approximately 40 to 60° C.

In addition, the approaching and retracting mechanism 19 is arranged such that the developing sleeve 14*a* is moved to a development position where the developing sleeve 14*a* approaches the photoconductor drum 12 and the developing sleeve 14*a* is moved to a retracting position where the developing sleeve 14*a* is retracted from the photoconductor drum 12 through the housing (without a symbol in the Figure) of the development device 14. in the image forming operation, the image forming parts 11Y, 11M, 11C and 11K basically execute the same operations as those of the first exemplary embodiment. However, in the image forming operation, the development device 14 is arranged at an approaching position by the approaching and retracting mechanism 19. In addition, in the image forming operation, the heating apparatus 18 does not heat the photoconductor drum 12.

In the light-induced fatigue setup of the setup operation executed after the image forming cartridge 60 is mounted on the printer 1, the image forming parts 11Y, 11M, 11C and 11K basically perform the same operations as those of the first exemplary embodiment. However, in the second exemplary embodiment, after the light irradiation of the whole region of the photoconductor drum 12 by the light source for light-induced fatigue 163, instead of application of the reverse charge bias, the photoconductive layer 126 (the overcoat layer 125) of the photoconductor drum 12 is heated by using the heating apparatus 18. In addition, at the time of heating the photoconductor drum 12 by using the heating apparatus 18, the approaching and retracting mechanism 19 causes the development device 14 to be retracted from the photoconductor drum 12.

In the second exemplary embodiment, uniform light-induced fatigue of the overcoat layer 125 occurs when the whole region of the photoconductive layer 126 constituting the photoconductor drum 12 is irradiated with light having a wavelength to which the overcoat layer 125 has a sensitivity, and the response is increased in the whole region. Then, after the uniform light-induced fatigue of the overcoat layer 125, excessive charges which exist in the overcoat layer 125 are erased and the flow of the charges in the face direction is suppressed by heating the whole region of the photoconductive layer 126, that is, the overcoat layer 125, to a predetermined temperature range.

Next, a description will be given for the evaluation tests carried out for reaching the above described configuration and their evaluation results.

FIG. 12 is a table showing the list of the conditions and results in the evaluation tests.

In the evaluation tests, firstly, similarly to the first exemplary embodiment, the photoconductor drum 12 attached to the image forming cartridge 60 is irradiated with light at 600 lx for 3 minutes by using the three-wavelength type daylight fluorescent lamp. As a result, there are formed a light exposure region which is exposed to the outside and a non-exposed region which is not exposed to the outside in the photoconductor drum 12. Subsequently, the image forming cartridge 60 is mounted on the printer 1, and 20% and 50% half-tone images are formed while the photoconductor drum 12 is rotated at a peripheral speed of 52 mm/sec.

Here, in a sample S11, the photoconductive layer 126 (the overcoat layer 125) is irradiated with light having a wavelength of 465 nm for one minute by using the light source for light-induced fatigue 163 before starting the image forming operation. Thereafter, heating is performed for one minute by using the heating apparatus 18 so that the surface temperature of the photoconductor drum 12 is 40° C. In addition, samples S12 to S14 are tested under the almost the same conditions as those of the sample 11, but the heating time is 3 minutes, 5 minutes and 10 minutes, respectively. Further, samples S15 to S18 are tested under the almost the same conditions as those of the samples S11 to S14, respectively, but the heating temperature is 50° C. Furthermore, a sample 19 is tested under the almost the same conditions as those of the sample 11 or sample 15, but the heating temperature is 60° C.

It should be noted that, the peripheral speed of the photoconductor drum 12 before the start of the image forming operation is set to 52 mm/sec, which is the same at the time of the image forming operation.

As a result, in all samples S11 to S19, the unevenness of an image is confirmed to be reduced (result A: the unevenness of an image is not recognized or result B: the unevenness of an image is hardly recognized). If the heating temperature of the photoconductive layer 126 is increased, for example, to approximately 80° C., the unevenness of an image is to be further reduced. However, when the temperature of the photoconductive layer 126 of the photoconductor drum 12 is too high, for example, the toner stored in the development device 14 may be agglomerated each other and adhere on the surface of the photoconductive layer 126 and the development roll, and further maybe solidified. Besides, the heating function of the heating apparatus 18 is required to be enhanced. For this reason, the heating temperature of the photoconductive layer 126 is preferably increased, for example, within a range not exceeding the glass transition point of the toner, in the position where the toner on the development roll is in contact with the photoconductive layer 126. In addition, if the heating temperature is set to less than 40° C., the unevenness of an image is to be insufficiently suppressed. For this reason, in this example, the heating temperature is selected from a range between 40° C. to 60° C.

In the first and second exemplary embodiments, descriptions have been given for the photoconductor drum 12 as an example, but the present invention is not limited to this. Alternatively, a photoconductor belt may be used.

In addition, in the first exemplary embodiment, the charging operation and the reverse charging operation of the photoconductor drum 12 are performed by using the charging device 13, but the present invention is not limited to this. For example, the reverse charging operation of the photoconductor drum 12 may be performed by using the primary transfer device 15, and a dedicated reverse charging apparatus may be attached to the photoconductor drum 12.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a rotatable photoconductor that is provided with a charge generation layer and an overcoat layer;

a charging unit that charges the rotating photoconductor before an image is formed;

an exposure unit that irradiates the rotating photoconductor with light having a wavelength to which a relative sensitivity of the charge generation layer is larger than a relative sensitivity of the overcoat layer, the relative sensitivity of the charge generation layer being a sensitivity to light having a wavelength range normalized by a maximum sensitivity of the charge generation layer in the wavelength range and the relative sensitivity of the overcoat layer being a sensitivity to light having a wavelength range normalized by a maximum sensitivity of the overcoat layer in the wavelength range;

a development unit that applies toner to an electrostatic latent image formed on the rotating photoconductor by the charging unit and the exposure unit;

a transfer unit that transfers an image developed on the rotating photoconductor to a medium;

a first light irradiation unit that irradiates the rotating photoconductor with light having a wavelength to which the relative sensitivity of the overcoat layer is larger than the relative sensitivity of the charge generation layer, the first light irradiation unit irradiating the rotating photoconductor with light before formation of the electrostatic latent image; and a reverse charging unit that charges the rotating photoconductor having been irradiated with light by the first light irradiation unit to a polarity opposite to a polarity of the rotating photoconductor initially charged by the charging unit, the reverse charging unit charging the rotating photoconductor before formation of the electrostatic latent image.

2. The image forming apparatus according to claim 1, wherein an absolute value of voltage applied to the reverse charging unit is larger than an absolute value of voltage applied to the charging unit.

3. The image forming apparatus according to claim 1, wherein the photoconductor is mounted on an image forming unit that is attached to and detached from a body of the image forming apparatus; and the image forming apparatus further comprises a controller that causes the first light irradiation unit to execute a light irradiation operation on the photoconductor of the image forming unit and that causes the reverse charging unit to execute a reverse charging operation on the photoconductor of the image forming unit, after the image forming unit is mounted on the body and before the electrostatic latent image is formed.

4. The image forming apparatus according to claim 3, wherein the controller further causes execution of a density correction operation of an image formed on the photoconductor after causing the first light irradiation unit to execute the light irradiation operation and causing the reverse charging unit to execute the reverse charging operation.

5. An image forming apparatus comprising:

a rotatable photoconductor that is provided with a charge generation layer and an overcoat layer;

a charging unit that charges the rotating photoconductor before an image is formed;

an exposure unit that irradiates the rotating photoconductor with light having a wavelength to which a relative sensitivity of the charge generation layer is larger than a relative sensitivity of the overcoat layer, the relative sensitivity of the charge generation layer being a sensitivity to light having a wavelength range normalized by a maximum sensitivity of the charge generation layer in the wavelength range and the relative sensitivity of the overcoat layer being a sensitivity to light having a wavelength range normalized by a maximum sensitivity of the overcoat layer in the wavelength range;

a development unit that applies toner to an electrostatic latent image formed on the rotating photoconductor by the charging unit and the exposure unit;

a transfer unit that transfers an image developed on the rotating photoconductor to a medium;

a first light irradiation unit that irradiates the rotating photoconductor with light having a wavelength to which the relative sensitivity of the overcoat layer is larger than the relative sensitivity of the charge generation layer, the first light irradiation unit irradiating the rotating photoconductor with light before formation of the electrostatic latent image; and a heating unit that heats the rotating photoconductor having been irradiated with light by the first light irradiation unit, the heating unit heating the rotating photoconductor before formation of the electrostatic latent image.

6. The image forming apparatus according to claim 5, wherein the development unit is provided with a developer carrier that is arranged opposed to the photoconductor and that rotates while holding the toner; and the heating unit heats the photoconductor at a temperature not exceeding a glass transition point of the toner when the toner held in the developer carrier is in contact with the photoconductor.

7. The image forming apparatus according to claim 5, wherein the photoconductor is mounted on an image forming unit that is attached to and detached from a body of the image forming apparatus; and the image forming apparatus further comprises a controller that causes the first light irradiation unit to execute a light irradiation operation on the photoconductor of the image forming unit and that causes the heating unit to execute a heating operation on the photoconductor of the image forming unit, after the image forming unit is mounted on the body and before the electrostatic latent image is formed.

8. The image forming apparatus according to claim 7, wherein the controller retracts the development unit from the photoconductor when causing the first light irradiation unit to execute the light irradiation operation and causing the heating unit to execute the heating operation.

9. The image forming apparatus according to claim 1, wherein the first light irradiation unit irradiates the overcoat layer with light having a wavelength of 400 nm and longer and 500 nm and shorter.

10. The image forming apparatus according to claim 1, further comprising a second light irradiation unit that irradiates the photoconductor with light having a wavelength range to which the relative sensitivity of the charge generation layer is larger than the relative sensitivity of the overcoat layer, after the transfer by the transfer unit.

11. The image forming apparatus according to claim 10, wherein the first light irradiation unit and the second light irradiation unit are arranged substantially in parallel in a peripheral direction of the photoconductor along a rotation axis direction of the photoconductor; and the image forming apparatus further comprises a power supply that supplies electric power to the first light irradiation unit and the second light irradiation unit while switching voltage.

12. An image forming apparatus comprising:

a rotatable photoconductor that is provided with a charge generation layer and an overcoat layer;

a charging unit that charges the rotating photoconductor before an image is formed;

an exposure unit that irradiates the rotating photoconductor with light having a wavelength at which a charge pair is generated more readily in the charge generation layer than in the overcoat layer;

a development unit that applies toner to an electrostatic latent image formed on the rotating photoconductor by the first charging unit and the exposure unit;

a transfer unit that transfers an image developed on the photoconductor to a medium;

a first light irradiation unit that irradiates the rotating photoconductor with light having a wavelength at which a charge pair is generated more readily in the overcoat layer than in the charge generation layer, the first light irradiation unit irradiating the rotating photoconductor with light before formation of the electrostatic latent image; and a reverse charging unit that charges the rotating photoconductor having been irradiated with light by the first light irradiation unit to a polarity opposite to a polarity of the rotating photoconductor initially charged by the first charging unit, the reverse charging unit charging the rotating photoconductor before formation the electrostatic latent image.

13. The image forming apparatus according to claim 12, wherein an absolute value of voltage applied to the reverse charging unit is larger than an absolute value of voltage applied to the charging unit.

14. The image forming apparatus according to claim 12, further comprising a second light irradiation unit that irradiates the photoconductor with light having a wavelength range to which a relative sensitivity of the charge generation layer is larger than a relative sensitivity of the overcoat layer, after the transfer by the transfer unit, the relative sensitivity of the charge generation layer being a sensitivity to light having a wavelength range normalized by a maximum sensitivity of the charge generation layer in the wavelength range and the relative sensitivity of the overcoat layer being a sensitivity to light having a wavelength range normalized by a maximum sensitivity of the overcoat layer in the wavelength range.

15. The image forming apparatus according to claim 14, wherein the first light irradiation unit and the second light irradiation unit are arranged substantially in parallel in a peripheral direction of the photoconductor along a rotation axis direction of the photoconductor; and the image forming apparatus further comprises a power supply that supplies electric power to the first light irradiation unit and the second light irradiation unit while switching voltage.

16. An image forming method for an image forming apparatus including a rotatable photoconductor having a charge generation layer and an overcoat layer, the image forming method comprising:

charging the rotating photoconductor before an image is formed;

irradiating the rotating photoconductor with light having a wavelength to which a relative sensitivity of the charge generation layer is larger than a relative sensitivity of the overcoat layer and exposing the photoconductor, the relative sensitivity of the charge generation layer being a sensitivity to light having a wavelength range normalized by a maximum sensitivity of the charge generation layer in the wavelength range and the relative sensitivity of the overcoat layer being a sensitivity to light having a wavelength range normalized by a maximum sensitivity of the overcoat layer in the wavelength range;

developing an electrostatic latent image formed on the rotating photoconductor by charging and irradiating, through application of toner;

transferring an image developed on the rotating photoconductor;

irradiating the rotating photoconductor with light having a wavelength to which the relative sensitivity of the overcoat layer is larger than the relative sensitivity of the charge generation layer, before forming the electrostatic latent image; and erasing a charge from the rotating photoconductor irradiated with light.

17. The image forming method according to claim 16, wherein, when the charge is erased from the photoconductor, the photoconductor is charged to a polarity opposite to a polarity at the time of charging the photoconductor.

18. The image forming method according to claim 16, wherein the photoconductor is heated and the charge is erased from the photoconductor.

19. The image forming apparatus according to claim 5, wherein the first light irradiation unit irradiates the overcoat layer with light having a wavelength of 400 nm and longer and 500 nm and shorter.

20. The image forming apparatus according to claim 5, further comprising a second light irradiation unit that irradiates the photoconductor with light having a wavelength range to which the relative sensitivity of the charge generation layer is larger than the relative sensitivity of the overcoat layer, after the transfer by the transfer unit.

21. The image forming apparatus according to claim 20, wherein the first light irradiation unit and the second light irradiation unit are arranged substantially in parallel in a peripheral direction of the photoconductor along a rotation axis direction of the photoconductor; and the image forming apparatus further comprises a power supply that supplies electric power to the first light irradiation unit and the second light irradiation unit while switching voltage.

* * * * *